US011913335B2

(12) United States Patent
Peters

(10) Patent No.: US 11,913,335 B2
(45) Date of Patent: Feb. 27, 2024

(54) APPARATUS AND METHOD FOR DRILLING A WELLBORE WITH A ROTARY STEERABLE SYSTEM

(71) Applicant: Baker Hughes Oilfield Operations LLC, Houston, TX (US)

(72) Inventor: Volker Peters, Wienhausen (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/338,378

(22) Filed: Jun. 3, 2021

(65) Prior Publication Data

US 2021/0381314 A1 Dec. 9, 2021

Related U.S. Application Data

(60) Provisional application No. 63/034,499, filed on Jun. 4, 2020.

(51) Int. Cl.

| | |
|---|---|
| ***E21B 7/06*** | (2006.01) |
| ***E21B 47/024*** | (2006.01) |
| ***E21B 44/02*** | (2006.01) |

(52) U.S. Cl.

CPC ..... *E21B 7/06* (2013.01); *E21B 44/02* (2013.01); *E21B 47/024* (2013.01)

(58) Field of Classification Search

CPC ..... E21B 44/02; E21B 47/024

See application file for complete search history.

(56) References Cited

U.S. PATENT DOCUMENTS

| | | | | |
|---|---|---|---|---|
| 2001/0042643 | A1 | 11/2001 | Krueger et al. | |
| 2006/0124354 | A1 | 6/2006 | Witte | |
| 2006/0185900 | A1* | 8/2006 | Jones | E21B 47/12 175/45 |
| 2008/0230273 | A1* | 9/2008 | Brooks | E21B 47/024 175/45 |
| 2014/0284110 | A1* | 9/2014 | Savage | E21B 7/06 175/73 |
| 2015/0096747 | A1* | 4/2015 | Brown-Kerr | E21B 47/12 166/66 |
| 2016/0138381 | A1 | 5/2016 | Logan et al. | |
| 2017/0198525 | A1* | 7/2017 | Feddema | E21B 7/06 |
| 2019/0271193 | A1 | 9/2019 | Peters et al. | |

* cited by examiner

*Primary Examiner* — Dany E Akakpo

(74) *Attorney, Agent, or Firm* — Crowe & Dunlevy, P.C.

(57) ABSTRACT

An apparatus for use in a wellbore includes a non-rotating section disposed along the drill string. The non-rotating section has a bore and at least one biasing member engaging an adjacent wall. A rotating section is disposed in the bore of the non-rotating section and a bearing is positioned between the rotating section and the non-rotating section. The apparatus also includes a relative rotation sensor that generates signals representative of a rotation of the rotating section relative to the non-rotating section, an orientation sensor that generates signals representative of an orientation of the non-rotating section relative to a selected frame of reference, and a controller in signal communication with the at least one relative rotation sensor and the at least one orientation sensor. The controller adjusts a force applied by the at least one biasing element, and/or a position of the at least one biasing element in response to the generated signals from the at least one relative rotation sensor and the generated signals from the at least one orientation sensor.

20 Claims, 22 Drawing Sheets

APPARATUS AND METHOD FOR DRILLING A WELLBORE WITH A ROTARY STEERABLE SYSTEM

CROSS REFERENCE TO RELATED APPLICATIONS

This application takes priority from U.S. Provisional App. Ser. No. 63/034,499, titled "APPARATUS AND METHOD FOR DRILLING A WELLBORE WITH A ROTARY STEERABLE SYSTEM" and filed on Jun. 4, 2020, the contents of which are incorporated by reference for all purposes. Also incorporated by reference for all purposes are the contents of the following: U.S. application Ser. No. 15/912,154, titled "ENCLOSED MODULE FOR A DOWNHOLE SYSTEM," filed on Mar. 5, 2018 and U.S. application Ser. No. 15/912,192, titled "ENCLOSED MODULE FOR A DOWNHOLE SYSTEM," filed on Mar. 5, 2018.

BACKGROUND

Directional drilling is commonly employed in hydrocarbon exploration and production operations. Directional drilling is typically accomplished using sensor modules and/or steering assemblies that act to change the direction of a drill bit. One type of directional drilling assembly involves a so-called "non-rotating sleeve" that includes devices for generating forces against a borehole wall or devices that bend a drive shaft passing through the non-rotating sleeve. In such applications, the non-rotating sleeve is typically supported by bearings that allow the sleeve to remain relatively stationary with respect to the earth formation. The stationary position of the sleeve allows for the application of relatively stationary forces to the borehole wall to create a steering direction.

SUMMARY

In one aspect, disclosed is an apparatus for use in a wellbore. The apparatus may include a drill string configured to drill the wellbore, a non-rotating section disposed along the drill string and having a bore and at least one biasing member engaging an adjacent wall, a rotating section disposed in the bore of the non-rotating section, a bearing between the rotating section and the non-rotating section that allows relative rotation between the rotating section and the non-rotating section, at least one relative rotation sensor configured to generate signals representative of a rotation of the rotating section relative to the non-rotating section, at least one orientation sensor configured to generate signals representative of an orientation of the non-rotating section relative to a selected frame of reference, and a controller in signal communication with the at least one relative rotation sensor and the at least one orientation sensor. The controller adjusts at least one of: (i) a force applied by the at least one biasing element, and (ii) a position of the at least one biasing element, the adjusting being in response to the generated signals from the at least one relative rotation sensor and the generated signals from the at least one orientation sensor.

A related method for using the apparatus includes disposing the above-described apparatus in an earth formation, varying a rotational frequency of the rotating section to transmit a control signal, using the controller to determine the control signal by detecting the rotational frequency variances using the at least one relative rotation sensor, and controlling a force and/or position of the at least one biasing element by using the determined control signal and the generated signals from the at least one orientation sensor.

In aspects, the present disclosure provides an apparatus for use in a wellbore. The apparatus may include a drill string configured to drill the wellbore; a non-rotating section disposed along the drill string, the non-rotating section having a bore and at least one biasing element engaging a wall of the wellbore; a rotating section disposed in the bore of the non-rotating section; at least one relative rotation sensor configured to generate signals representative of a rotation of the rotating section relative to the non-rotating section; at least one orientation sensor within the non-rotating section configured to generate signals representative of an orientation of the non-rotating section relative to a selected frame of reference; and a controller. The controller may be in signal communication with the at least one relative rotation sensor and the at least one orientation sensor, the controller being configured to adjust at least one of: (i) a force applied by the at least one biasing element, and (ii) a position of the at least one biasing element, the adjusting being in response to the generated signals representative of a rotation of the rotating section relative to the non-rotating section from the at least one relative rotation sensor and the generated signals representative of an orientation of the non-rotating section relative to a selected frame of reference from the at least one orientation sensor.

In aspects, the present disclosure provides a method of using an apparatus in a wellbore. The method may include disposing a drill string in the wellbore, the drill string being configured to drill the wellbore. The drill string may include (i) a non-rotating section disposed along the drill string, the non-rotating section having a bore and at least one biasing element configured to engage a wall of the wellbore, (ii) a rotating section disposed in the bore of the non-rotating section, (iii) at least one relative rotation sensor configured to generate signals representative of a relative rotation between the rotating section and the non-rotating section, (iv) at least one orientation sensor in the non-rotating section and configured to generate signals representative of an orientation of the non-rotating section relative to a selected frame of reference, and (v) a controller in signal communication with the at least one relative rotation sensor and the at least one orientation sensor. The method may include the further steps of varying a speed of the rotation of the rotating section to transmit a control signal; using the controller to determine the control signal by detecting the rotational frequency variances using the at least one relative rotation sensor; receiving energy within the non-rotating section from the rotation of the rotating section and controlling a force and/or position of the at least one biasing element by using the determined control signal and the generated signals representative of the orientation of the non-rotating section relative to the selected frame of reference from the at least one orientation sensor.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Apparatuses, systems and methods for directional drilling through an earth formation are described herein. An embodiment of a directional drilling device or system includes a self-contained module configured to be incorporated in a downhole component that may include a substantially non-rotating sleeve. The module is hermetically sealed and is modular, i.e., the self-contained module may be easily exchanged for other modules to reduce turn-around time. In accordance with an exemplary aspect, the self-contained module can be installed on and/or removed from the downhole component or the substantially non-rotating sleeve without having to electrically disconnect the module or otherwise impact other components of the system such as the downhole component, the directional drilling device, the substantially non-rotating sleeve and/or a steering system.

The self-contained module houses and at least partially encloses or encapsulates one or more of a variety of components to facilitate or perform functions such as steering, measurement and/or others. In one embodiment, the self-contained module houses and at least partially encloses a biasing device (e.g. a cylinder and piston assembly) that can be actuated to affect changes in drilling direction. The self-contained module may include an energy storage device (e.g., a battery, a rechargeable battery, a capacitor, a super-capacitor, or a fuel cell). In one embodiment, the self-contained module may house an energy transmitting/receiving device configured to supply energy, such as electrical energy to components in the module. The energy transmitting/receiving device may generate electricity, e.g. via inductive coupling with a magnetic field generated due to rotation of a drive shaft or other component of a drill string.

Figure 1:
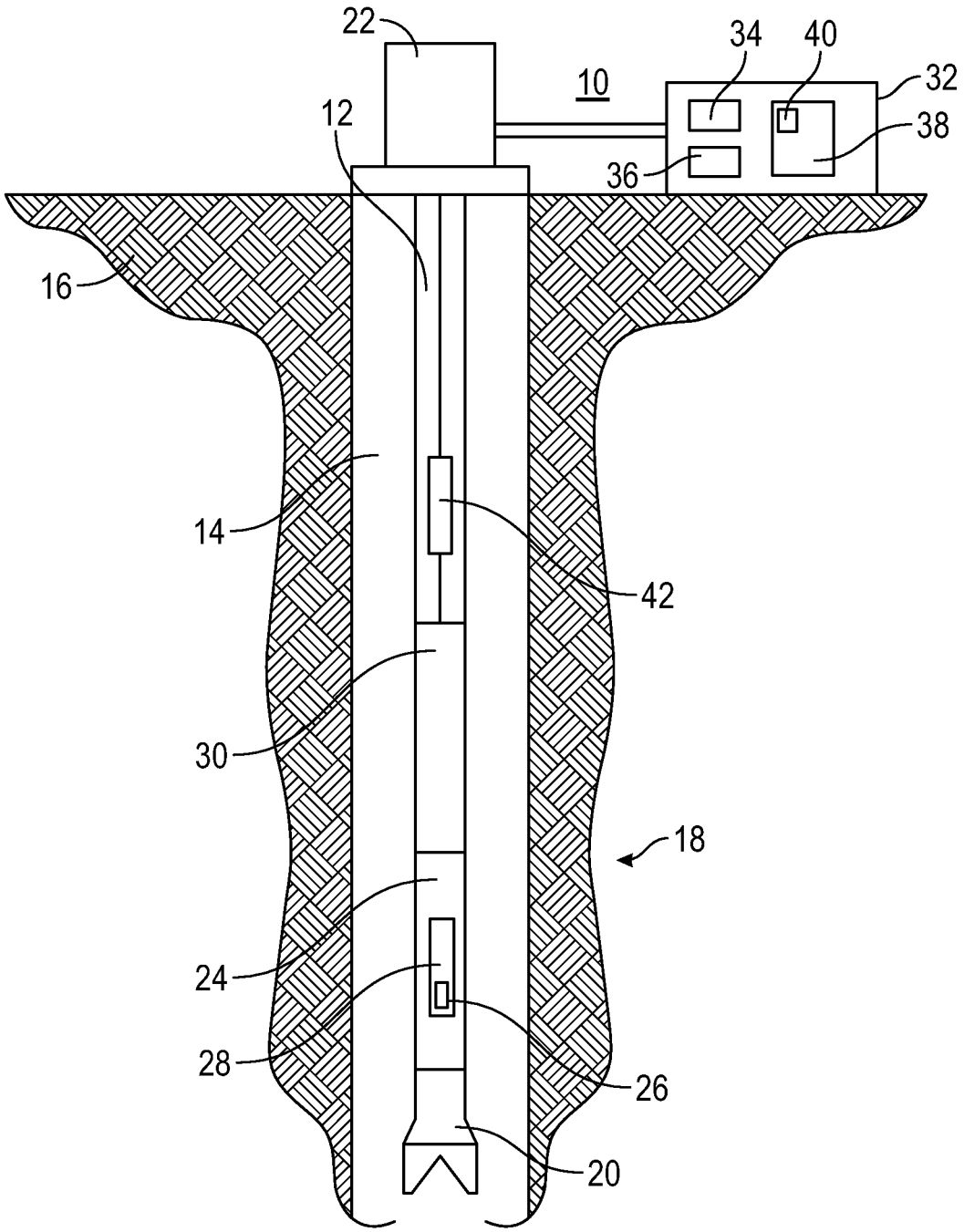
FIG. 1 depicts an embodiment of a drilling and/or measurement system.

FIG. 1 illustrates an exemplary embodiment of a well drilling, exploration, productions, measurement (e.g., logging) and/or geosteering system 10, which includes a drill string 12 configured to be disposed in a borehole 14 that penetrates an earth formation 16. Although the borehole 14 is shown in FIG. 1 to be of constant diameter and direction, the borehole is not so limited. For example, the borehole 14 may be of varying diameter and/or direction (e.g., varying azimuth and inclination). The drill string 12 is made from, for example, a pipe, multiple pipe sections or coiled tubing. The system 10 and/or the drill string 12 includes a drilling assembly (including, e.g., a drill bit 20 and steering assembly 24) and may include various other downhole components or assemblies, such as measurement tools 30 and communication assemblies, one or more of the drilling assembly, the measurement tools 30, and the communication assemblies may be collectively called a bottomhole assembly (BHA) 18. Measurement tools may be included for performing measurement regimes such as logging-while-drilling (LWD) applications and measurement-while-drilling (MWD) applications. Sensors may be disposed at one or multiple locations along a borehole string, e.g., in the BHA 18, in the drill string 12, in measurement tool 30, such as a logging sonde, or as distributed sensors.

The drill string 12 drives a drill bit 20 that penetrates the earth formation 16. Downhole drilling fluid, such as drilling mud, is pumped through a surface assembly 22 (including, e.g., a derrick, rotary table or top drive, a coiled tubing drum and/or standpipe), the drill string 12, and the drill bit 20 using one or more pumps, and returns to the surface through the borehole 14.

Steering assembly 24 includes components configured to steer the drill bit 20. In one embodiment, steering assembly 24 includes one or more biasing elements 26 configured to be actuated to apply lateral force to the drill bit 20 to accomplish changes in direction. One or more biasing elements 26 may be housed in a module 28 that can be removably attached to a sleeve (not separately labeled) in the steering assembly 24.

Various types of sensors or sensing devices may be incorporated in the system and/or drill string. For example, sensors such as magnetometers, gravimeters, accelerometers, gyroscopic sensors and other directional and/or location sensors can be incorporated into steering assembly 24 or in a separate component. Various other sensors can be incorporated into the BHA 18, such as into the steering assembly 24 and/or into the measurement tool 30. Examples of measurement tools include resistivity tools, gamma ray tools, density tools, or calipers.

Other examples of devices that can be used to perform measurements include temperature or pressure measurement tools, pulsed neutron tools, acoustic tools, nuclear magnetic resonance tools, seismic data acquisition tools, acoustic impedance tools, formation pressure testing tools, fluid sampling and/or analysis tools, coring tools, tools to measure operational data, such as vibration related data, e.g. acceleration, vibration, weight, such as weight-on-bit, torque, such as torque-on-bit, rate of penetration, depth, time, rotational velocity, bending, stress, strain, any combination of these, and/or any other type of sensor or device capable of providing information regarding earth formation 16, borehole 14 and/or operation.

Types of sensors may include discrete sensors (e.g., strain and/or temperature sensors) along the drill string sensors or sensor systems comprising one or more transmitter, receiver, or transceivers at some distance, as well as distributed sensor systems with various discrete sensors or sensor systems distributed along the system 10. It is noted that the number and type of sensors described herein are exemplary and not intended to be limiting, as any suitable type and configuration of sensors can be employed to measure properties.

A processing unit 32 is connected in operable communication with components of the system 10 and may be located, for example, at a surface location. The processing unit 32 may also be incorporated at least partially in the drill string 12 or the BHA 18 as part of downhole electronics 42, or otherwise disposed downhole as desired. Components of the drill string 12 may be connected to the processing unit 32 via any suitable communication regime, such as mud pulse telemetry, electro-magnetic telemetry, acoustic telemetry, wired links (e.g., hard wired drill pipe or coiled tubing), wireless links, optical links or others. The processing unit 32 may be configured to perform functions such as controlling drilling and steering (e.g., by steering assembly 24), transmitting and receiving data (e.g., to and from the BHA 18 and/or the module 28), processing measurement data and/or monitoring operations. The processing unit 32, in one embodiment, includes a processor 34, a communication and/or detection member 36 for communicating with downhole components, and a data storage device (or a computer-readable medium) 38 for storing data, models and/or computer programs or software 40. Other processing units may comprise two or more processing units at different locations in system 10, wherein each of the processing units comprise at least one of a processor, a communication device, and a data storage device.

Figure 2:
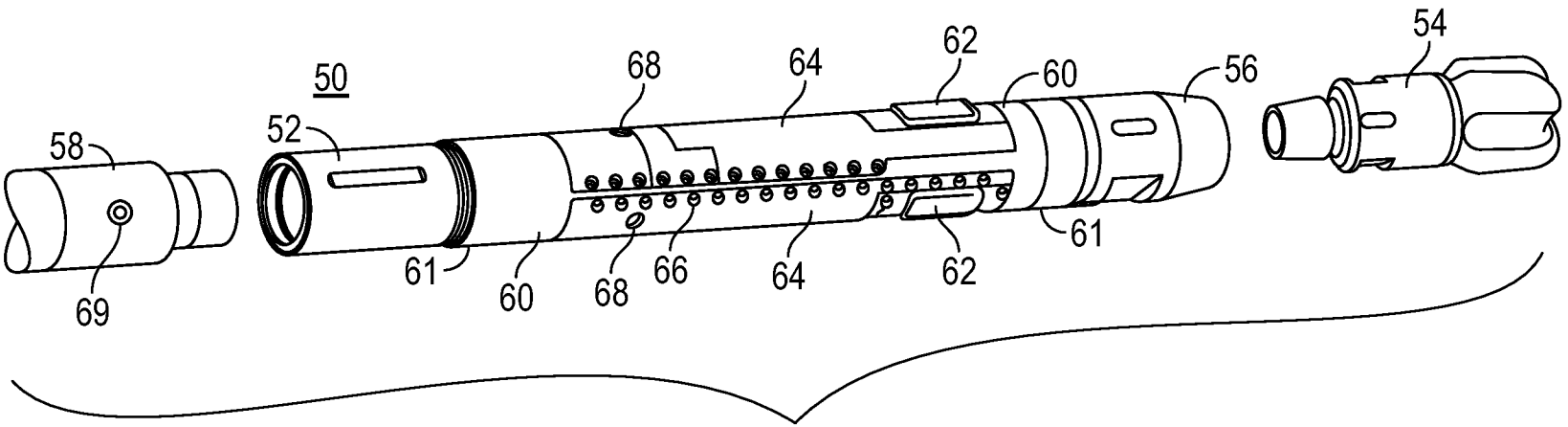
FIG. 2 depicts an embodiment of a steering assembly for a drilling system, which includes a module mounted on a non-rotating sleeve.
Figure 3:
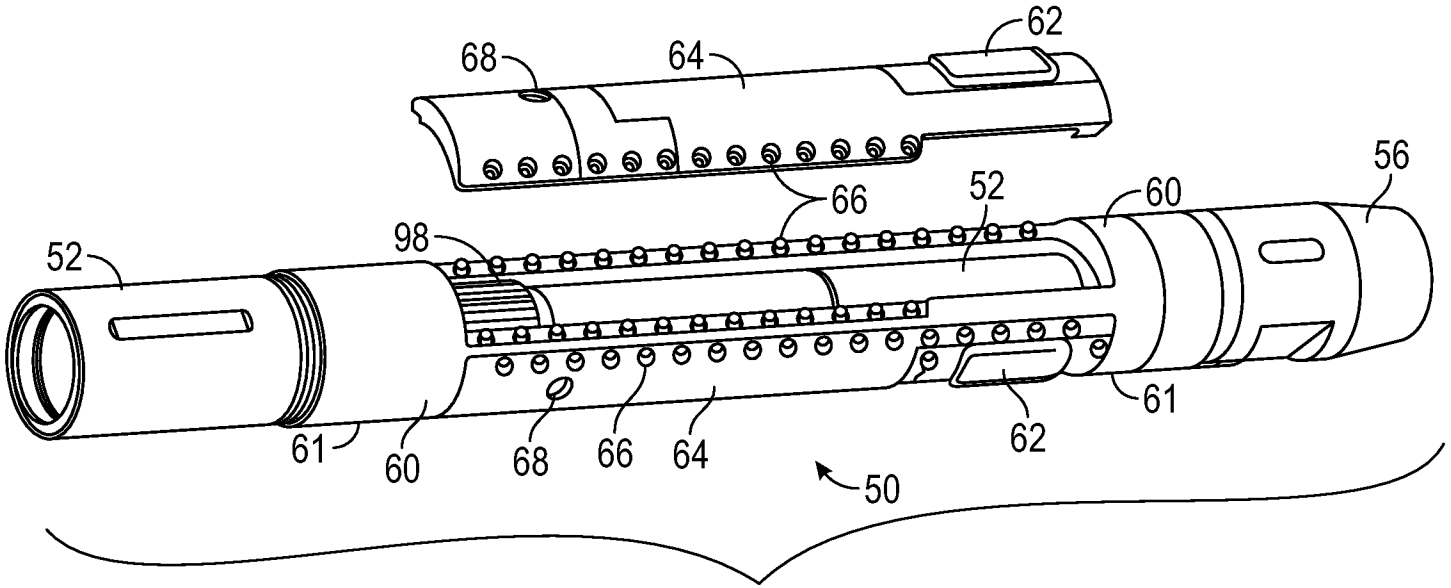
FIG. 3 depicts the steering assembly of FIG. 2 with the module removed from the non-rotating sleeve.

FIGS. 2 and 3 illustrate an embodiment of a steering assembly 50 for use in directional drilling. The steering assembly 50 may be incorporated into the system 10 (e.g., in BHA 18) or may be part of any other system configured to perform drilling operations. The steering assembly 50 includes a drive shaft 52 configured to be rotated from the surface, e.g. by a top drive (not shown), that may be part of surface assembly 22, or downhole (e.g., by a mud motor or turbine (also not shown) that may be part of the BI-IA 18. The drive shaft 52 can be connected at one end to a disintegrating device, such as a drill bit 54 via, e.g., a connector, such as a bit box connector 56. The disintegrating device, in combination with or in place of the drill bit 54, may include any other device suitable for disintegrating the rock or earth formation, including, but not limited to, an electric impulse device (also referred to as electrical discharge device), a jet drilling device, or a percussion hammer.

The drive shaft 52 can be connected at the other end and/or at the same end between the disintegrating tool and the drive shaft 52 to a downhole component 58, such as mud motor (not shown), a communication tool to provide communication from and to surface assembly 22, a power generator (not shown) that generates power downhole for driving other tools in the BHA 18, such as the downhole electronics, 42, the measurement tool 30 including sensors, such as formation evaluation sensors, or operational sensors, a reamer (e.g. an underreamer, not shown) the steering assembly 24, 50, or a pipe section in drill string 12, via a suitable string connection such as a pin-box connection. Some of the downhole components 58, such as measurement tools, may benefit from the close position to the disintegrating device when connected at the lower end of drive shaft 52 between disintegrating device and the steering assembly 50.

The steering assembly 50 also includes a sleeve 60 that surrounds a portion of the drive shaft 52. The sleeve 60 may include one or more biasing elements 62 that can be actuated to control the direction of the drill bit 54 and the drill string 12. Examples of biasing elements include devices such as cylinders, pistons, wedge elements, hydraulic pillows, expandable rib elements, blades, and others.

The sleeve 60 is mounted on the drive shaft via bearings 61 or another suitable mechanism so that the sleeve 60 is to at least some extent rotationally decoupled from the drive shaft 52 or other rotating components. For example, the sleeve 60 is connected to bearings 61, e.g. mud lubricated bearings, that may be any type of bearings including but not limited to contact bearings, such as sliding contact bearings or rolling contact bearings, journal bearings, ball bearings or bushings. The sleeve 60 may be referred to as a "non-rotating sleeve", or "slowly rotating sleeve" which is defined as a sleeve or other component that is to at least some extent rotationally decoupled from rotating components of the steering assembly 50. During drilling, the sleeve 60 may not be completely stationary, but may rotate at a lower rotational speed compared to the drive shaft 52 due to the friction between sleeve 60 and drive shaft 52, e.g., friction that is generated by bearings 61. The sleeve 60 may have slow or no rotational movement compared to the drive shaft 52 (e.g., when biasing elements 62 are engaged with a borehole wall), or may rotate independent of the drive shaft 52 (usually the sleeve 60 rotates at a much lower rate than the drive shaft 52) especially when the biasing elements 62 are actively engaged.

For example, while drive shaft 52 may rotate between about 100 to about 600 revolutions per minute (RPM), the sleeve 60 may rotate at less than about 2 RPM Thus, the sleeve 60 is substantially non-rotating with respect to the drive shaft 52 and is, therefore, referred to herein as the substantially non-rotating or non-rotating sleeve, irrespective of its actual rotating speed. In some instances, the biasing elements 62 can be supported by spring elements (not shown), such as a coil spring, or a spring washer, e.g. a conical spring washer to engage with the earth formation even when the biasing elements 62 are not actively powered.

In one embodiment, the biasing element 62 (or elements) is configured to engage the borehole wall and provide a lateral force component to the drive shaft 52 through the bearings 61 to cause the drive shaft 52 and the drill bit 54 to change direction. One or more biasing elements 62 are connected to the non-rotating sleeve 60 to apply relatively stationary forces to the borehole wall (also referred to as "pushing the bit") or to deflect the drive shaft 52, causing the bend direction of the rotating drive shaft 52 to create a steering direction (also referred to as "pointing the bit").

Since the non-rotating sleeve 60 rotates significantly slower or does not rotate at all with respect to the earth formation 16, the biasing elements 62, and thus, the forces applied to the borehole wall have a direction that varies relatively slowly compared to the faster rotation of the drive shaft 52. This allows for a force applied to the borehole wall to keep a desired steering direction with much less variation compared to a scenario where the biasing element 62 rotates with the drive shaft 52. In this manner, the power required to achieve and/or keep a desired steering direction is significantly lower as compared to a system in which the biasing element 62 rotates with the drive shaft 52, Thus, utilization of the non-rotating sleeve 60 allows for operation of steering systems with relatively low power demand.

The sleeve 60 may be a modular component of the steering assembly 50. In aspects, the sleeve 60 can be installed on and removed from the steering assembly 50 without having to electrically disconnect the sleeve or otherwise impact other components of the steering system. Alternatively, or in addition, the sleeve 60 also includes one or more modules 64 configured to enclose or house one or more components for facilitating steering functions. Each module 64 is mechanically and electrically self-contained and modular, in that the module 64 can be attached to and removed from the sleeve 60 without affecting components in the module 64 or steering assembly 50.

For example, each module 64 includes mechanical attachment features such as clamping elements (not shown), e.g. devices for thermal clamping, devices including shape memory alloy, press fit devices, or tapered fit devices, or screw holes 66 that allow the module 64 to be fixedly connected to the sleeve 60 with a removable fixing mechanism such as screws, bolts, threads, magnets, or clamping elements, e.g. mechanical clamping elements, thermal clamping elements, clamping elements including shape memory alloy, press fit elements, tapered fit elements, and/or any combination thereof. Further, in another example, module 64 may be fixedly connected to the sleeve 60 with removable fixing mechanism such as screws, bolts, threads, magnets, or clamping elements, e.g. mechanical clamping elements, thermal clamping elements, clamping elements including shape memory alloy, press fit elements, tapered fit elements, or any combination thereof without any non-removable fixing elements.

Each module 64 may at least partially enclose one or more biasing elements 62, and may include one type of biasing element 62 or multiple types of biasing elements 62. It is noted that each module 64 can include a respective biasing element 62 and associated controller, allowing each biasing element 62 to be operated independently.

In the embodiment of FIGS. 2 and 3, the sleeve 60 includes three modules 64 circumferentially arranged (e.g., separated by the same angular distance). However, the sleeve 60 is not so limited and can include a single module 64 or any suitable number of modules 64. Also, the module or modules 64 can be positioned at any suitable location or configuration.

Each module 64 and/or the sleeve 60 may include sealing components to allow for hermetically sealing the module 64 to the sleeve 60 so as to prevent fluid from flowing through the wall of the sleeve 60. Alternatively, the module 64 may be attached to the sleeve 60 without sealing the module 64 to the sleeve 60, e.g. without any fluid sealing elements beyond the mechanical attachment discussed above.

In one embodiment, each module 64 is configured to communicate with components outside of the module 64 without a physical electrical connection, such as a wire or cable. That is, the module 64 is electrically isolated while still be configured to receive energy and/or data.

The modules 64 can therefore be handled as enclosed units, even when they are detached from the sleeve 60. Thus, as the modules 64 may be hermetically enclosed units, they can, for instance, be tested, verified, calibrated, maintained, and/or repaired, or it can exchange data (download or upload), without the need to attach the modules 64 to the sleeve 60, or simply be cleaned, e.g. by using a regular high pressure washer. The modules 64 may further be exchanged when not working properly to quickly repair the steering assembly 50 during or in preparation of a drilling job. That is, modules 64 may be exchanged by accessing the BHA 18 or steering assembly 24 from the outer periphery of the BHA 18 or steering assembly 24, This allows to exchange modules 64 without breaking string connections.

In particular, module 64 may be exchanged without disconnecting the string connections at the upper and/or lower end of the steering assembly and without disassembling the steering assembly 24 from the BI-IA 18 or drill string 12. In particular, module 64 may be exchanged while the steering assembly 24 is connected, e.g. mechanically connected to at least a part of the BHA 18 or drill string 12 via one or more drill string connections. Exchanged modules may be sent to an offsite repair and maintenance facility for further investigation and maintenance without the need to ship the steering assembly 50 or to disconnect the steering assembly 50 from at least a part of the BHA 18 or drill string 12. That is, testing, verification, calibration, data transfer (upload or download data), maintenance, and repair can be done on a module level rather than on a tool level. This allows for a quick exchange of modules to repair assemblies and to ship relatively small modules rather than complete downhole drilling tools.

In addition, exemplary embodiments allows for a quick exchange of modules from an outer periphery of steering assembly 24 to affect a repair while the steering assembly 24 is still physically connected to the BHA 18 and/or the drill string 12. The capability for a quick exchange of modules to repair steering assembly 24 and the option to ship relatively small modules rather than complete downhole drilling tools and/or the capability for a quick exchange of modules to repair assemblies while the steering assembly 24 is still physically connected to the BHA 18 and/or drill string 12, for example via the string connector, is a major benefit that facilitates a significant reduction in operational cost.

As noted, one or more of modules 64 may be configured to communicate wirelessly with a communication device, such as an antenna 69 and/or an inductive coupling device at a component such as a pipe segment, BHA 18, the drill bit 20, the drive shaft 52 or other downhole component 58 or another module 64 in the same or in another component.

Figure 4A:
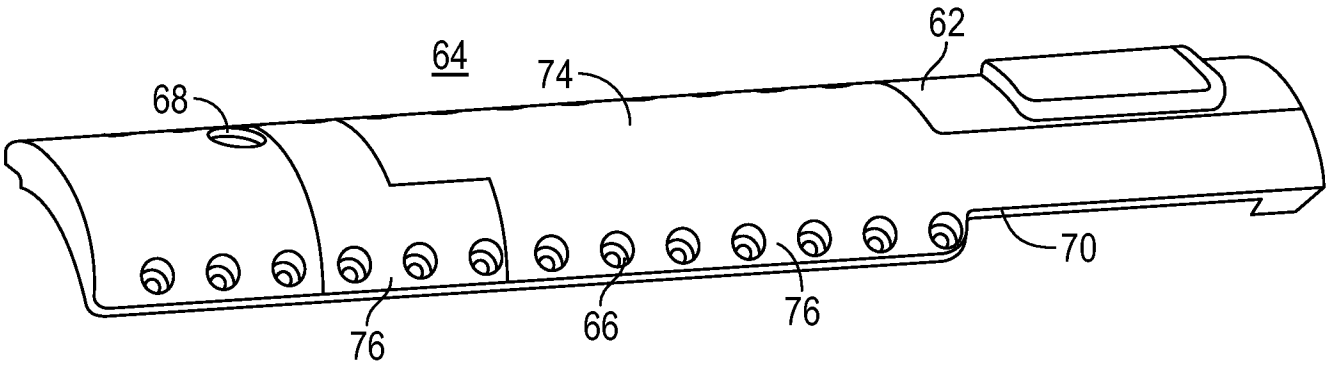
FIGS. 4A and 4B are perspective views of a module configured to be incorporated in a steering system.
Figure 4B:
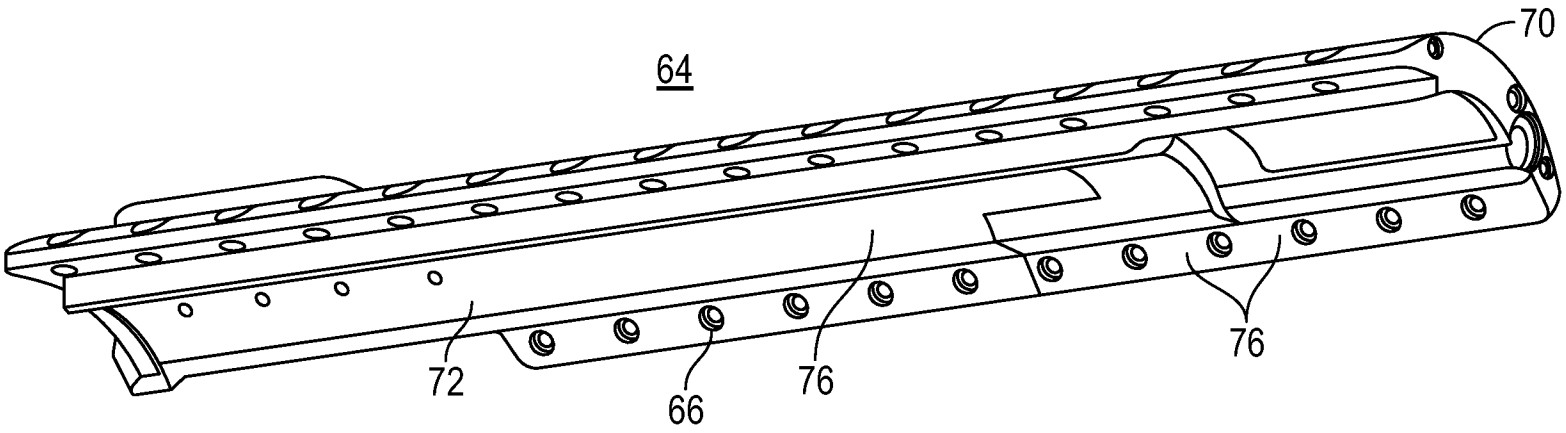

FIGS. 4A and 4B show perspective views of module 64. As shown, in one embodiment, the module 64 includes a housing 70 that has a shape configured to be removably attached (e.g., via screws, bolts, threads, magnets, or clamping elements, e.g. mechanical clamping elements, thermal clamping elements, clamping elements including shape memory alloy, press fit elements, tapered fit elements, or any combination thereof) to a correspondingly shaped cutout (not separately labeled) in the wall of the sleeve 60. The module 64 may have a thickness equal to or similar to the thickness of the sleeve 60, and thereby form part of the wall. Alternatively, the module 64 may have a thickness that is less than the thickness of the sleeve 60, and can be mounted at a recess (not separately labeled) formed in the sleeve wall. The thickness of the module 64 may be sized to house the various parts and components included in the module 64 as discussed further below. The module 64 may also be curved so as to conform to the curvature of the sleeve 60, which is typically cylindrical. Optionally, module 64 may be covered by a hatch cover (not separately labeled).

The housing 70 may be an integral part that is accessible via openings, such as open holes or ports may also include a number of housing components, such as a lower housing component 72, which can be a single integral housing component or have multiple housing components. An upper housing component 74 may also be a single integral housing component or have multiple housing components, and can be attached to the lower housing component 72 via a permanent joining (e.g., by welding, gluing, brazing, adhesive attachment) or a removable joining (e.g., screws, bolts, threads, magnets, or clamping elements, e.g. mechanical clamping elements, thermal clamping elements, clamping elements including shape memory alloy, press fit elements, tapered fit elements, or any combination thereof). It is noted that the terms "upper" and "lower" are not intended to prescribe any particular orientation of the module 64 with respect to, e.g., a drill string, sleeve or borehole.

As shown in FIGS. 4A and 4B, the housing 70, lower housing component 72 and/or upper housing component 74 can be made from multiple sections 76. For example, the housing 70 is divided into multiple sections 76 that can house different components and can be removably (such as by screws, bolts, threads, magnets, or clamping elements, e.g. mechanical clamping elements, thermal clamping elements, clamping elements including shape memory alloy, press fit elements, tapered fit elements, or any combination thereof) or permanently (such as by welding, gluing, brazing, or adhesive attachment) joined together.

Figure 5:
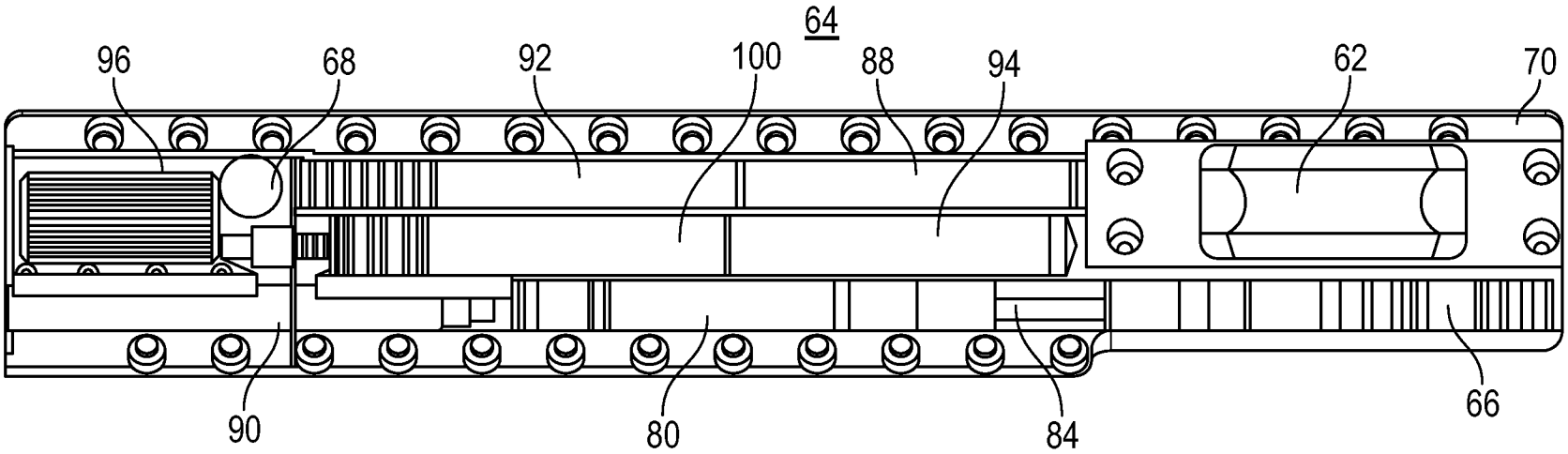
FIG. 5 is an internal view of the module of FIGS. 4A and 4B.
Figure 6:
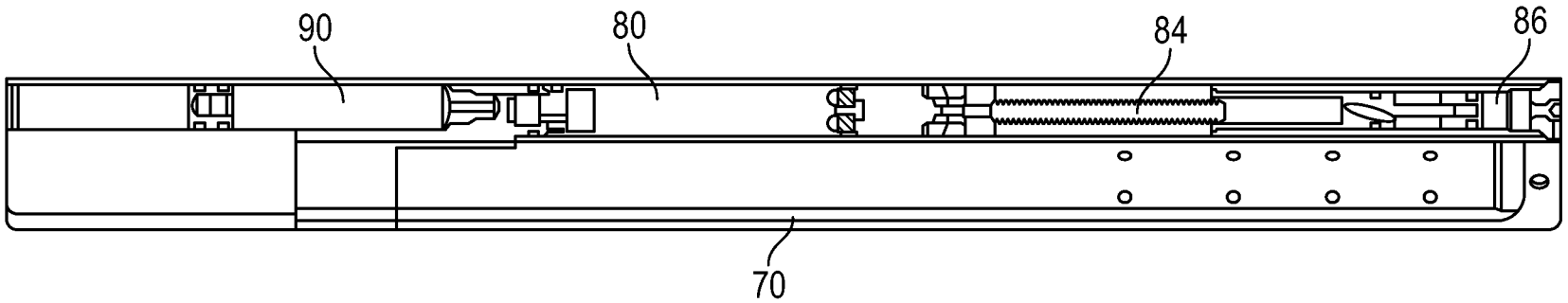
FIG. 6 is a cross-sectional view of the module of FIGS. 4A and 4B.
Figure 7:
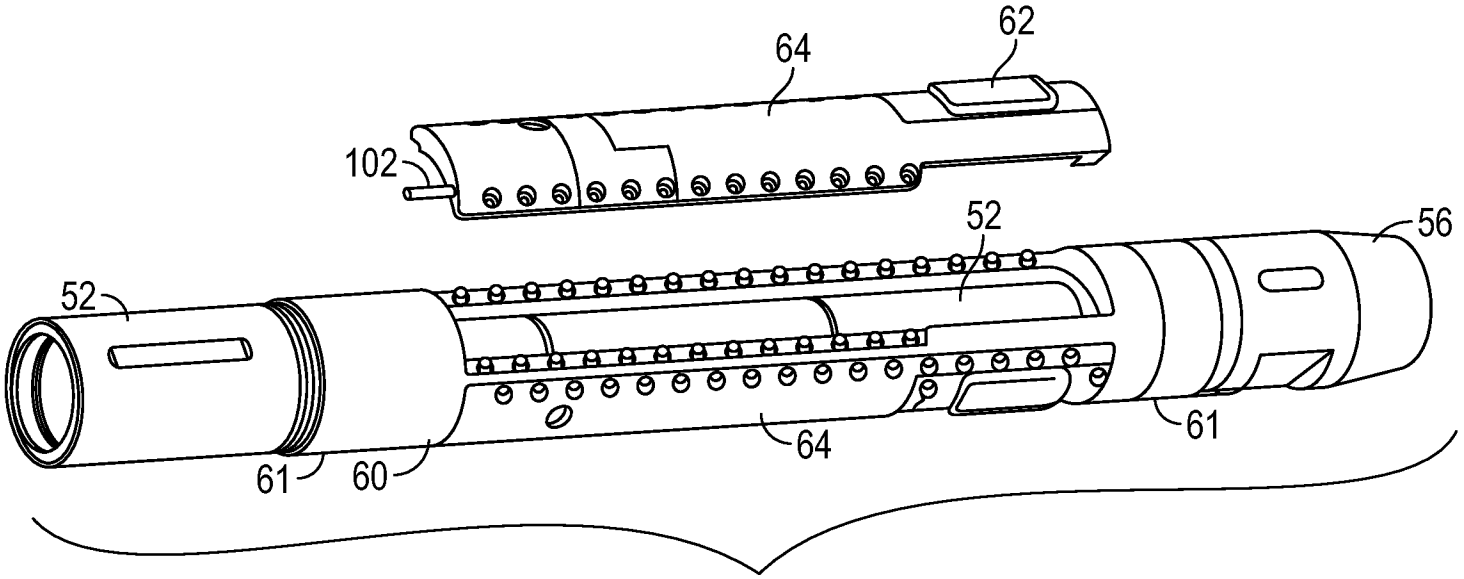
FIG. 7 depicts an embodiment of a steering assembly for a drilling system, which includes a module mounted on a non-rotating sleeve and an energy transmitting/receiving device.
Figure 8:
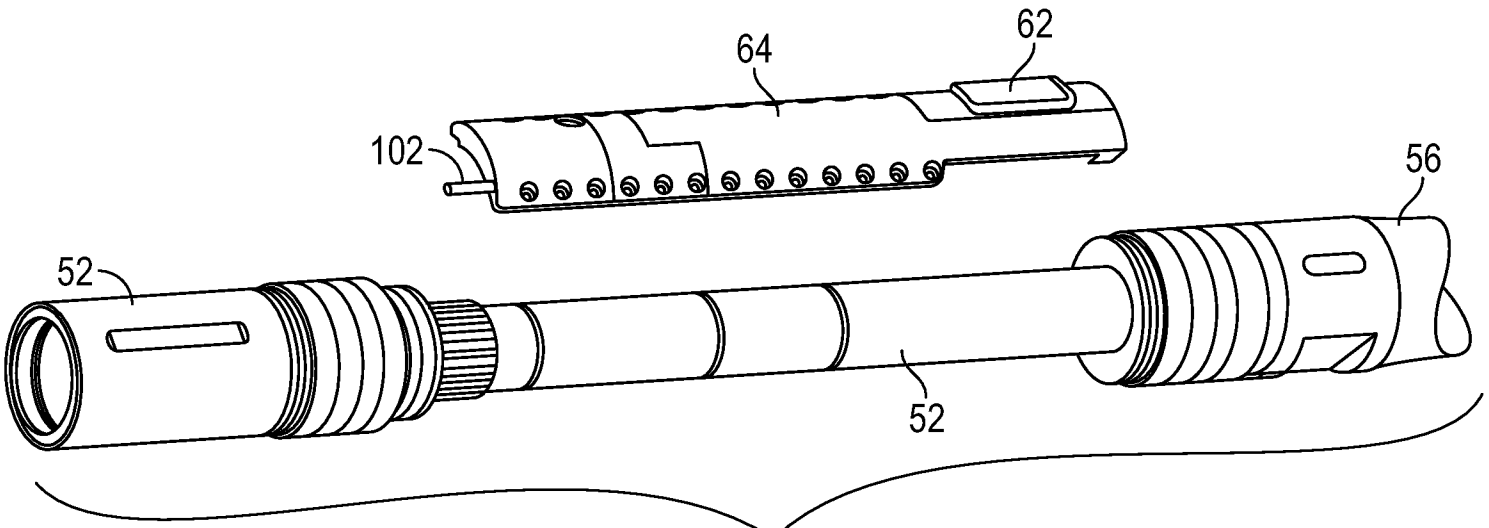
FIG. 8 is perspective view of the module of the steering assembly of FIG. 7.
Figure 9:
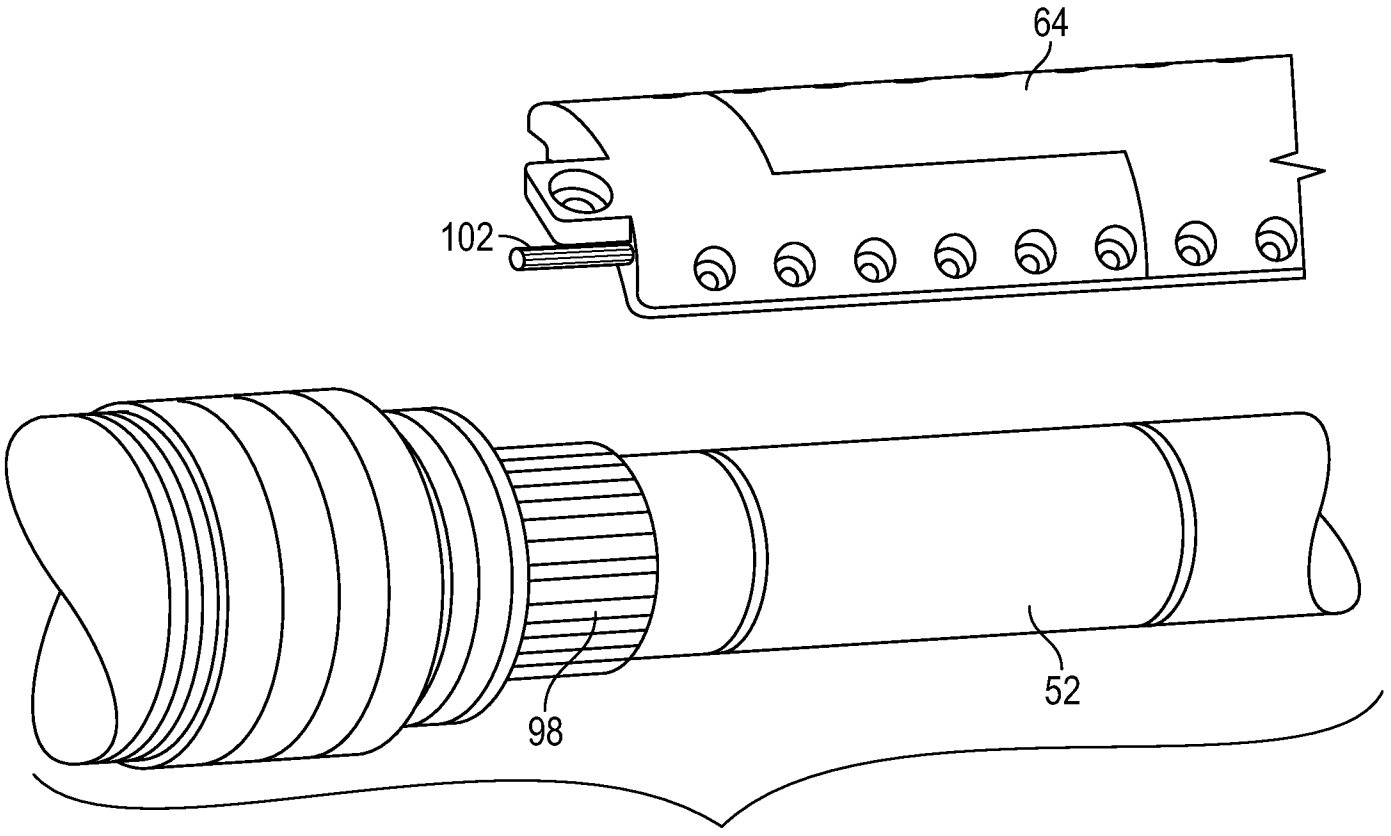
FIG. 9 is a close up view of secondary device disposed in the module of the steering assembly of FIG. 7, which is configured to receive energy inside the module in the non-rotating sleeve from a rotating part of the steering assembly that is rotationally decoupled from the non-rotating sleeve.

FIGS. 5 and 6 show an example of components that can be housed in the module 64. It is noted that the components are not limited to those shown in FIGS. 5 and 6, and are further not limited to the specific orientations, shaped and positions shown. Each component may be secured in any suitable manner. For example, the module 64 can include recesses shaped to conform to respective devices to be disposed therein. In one embodiment, the devices may be encapsulated and secured in place via the upper housing component 74 and/or one or more panels. In another embodiment, the devices may be installed into the modules 64 via ports or open holes, such as between upper and lower housing components 72, 74. The devices may also be disposed separately in sections 76.

In the example of FIGS. 5 and 6, the module 64 includes the biasing element 62, the antenna 68 and various devices for performing functions related to steering, communication, power supply, processing and others. Such devices may include power supply devices, power storage devices, data storage devices, biasing control devices, communication devices, and electronics such as one or more controllers/processors, or data storage devices. Examples of devices that can be housed in the module 64 are discussed below, however the module 64 and constituent devices are not so limited. In particular, antenna 68 is an optional device that may be omitted without significantly reducing the system's functionality. That is, as further discussed herein, communication from and to self-contained modules 64 can be accomplished via magnets 98 and secondary shaft 102 (e.g. magnets 98 and secondary shaft 102 of energy transmitting/receiving device 96). Hence, one embodiment is a steering assembly 50 featuring a non-rotating sleeve 60 with one or more self-contained modules 64 that do not comprise an antenna such as antenna 68.

The module 64 may also include a control mechanism for operating the biasing element 62. Examples of the control mechanism include, a hydraulic pump and/or a hydraulically controlled actuator, and a motor, such as an electric motor.

In the example of FIGS. 5 and 6, the module 64 includes a biasing control assembly for controlling the biasing element 62 (e.g., a hydraulic piston assembly), which includes a pump, comprising a motor 80, such as an electric motor and a linear motion device 84 such as a spindle drive or ball screw drive. Optionally, a gear (not shown) might be included between the motor 80 and the linear motion device 84 to increase the efficiency of rotary movement of the motor 80 and the linear movement of the linear motion device 84. The linear motion device 84 is coupled to the biasing element 62 via, e.g., a hydraulic coupling 86 utilizing a working fluid such as a hydraulic oil. In addition, or alternatively, valves (not shown) may be controlled by a controller 88 to direct the working fluid to apply appropriate pressure to the biasing element 62 via the hydraulic coupling 86. Optionally, a linear variable differential transformer (LVDT) (not shown) may be included to monitor, confirm, and/or measure the movement and/or an amount of engagement of a biasing member. As noted above, the utilization of the non-rotating sleeve 60 in conjunction with the operation of the biasing elements 62 allows for operation of steering systems with relatively low power demand. For example, the module 64 features low power stationary (hydrostatic) hydraulics to decrease the overall power demand.

To control the force and position of the biasing element 62, the module 64 includes control electronics or controller 88 that may include a data storage device. Controller 88 controls operation of the biasing control assembly by controlling at least one of the pump, the motor 80, the linear motion device 84, and/or one or more valves (not separately labeled). The module 64 may include or be in communication with (e.g., via the antenna 68) one or more directional sensors to measure directional characteristics of the BHA 18 or parts of the BHA 18, such as the measurement tool 30, the steering assembly 50 and/or the drill hit 54. In one embodiment, the directional sensors are configured to detect or estimate the azimuthal direction, the toolface direction, or the inclination of the sleeve 60. Examples of directional sensors include bending sensors, accelerometers, gravimeters, magnetometers, and gyroscopic sensors.

Any other suitable sensors may be included in the module or in communication with the module that might benefit from a position close to the bit. Examples of such sensors include formation evaluation sensors such as but not limited to sensors to measure resistivity, gamma, density, caliper, and/or chemistry, or sensors to measure operational data, such as time, drilling fluid properties, temperature, pressure, vibration related data, e.g. acceleration, weight, such as weight-on-hit, torque, such as torque-on-bit, depth, rate of penetration, rotational velocity, bending, stress, strain, and/or any other type of sensor or device capable of providing information regarding an earth formation, borehole and/or operation.

Another component that can be included in the module 64 is a pressure compensation device such as a pressure compensator 90. The pressure compensator 90 in this example is encapsulated within the module 64, except for a surface that is movable or flexible and exposed to fluid pressure. The pressure compensator 90 may be utilized to provide reference pressure that may equal or be related to fluid pressure external of the module 64 and/or to provide compensation fluid volume. The reference pressure may be provided to the motion device 84 and/or motor 80 in order to create a pressure difference with respect to the reference pressure to direct the working fluid to apply appropriate pressure to the biasing element 62 via the hydraulic coupling 86. Alternatively, or in addition, the compensation fluid volume may be utilized for compensating fluid-filled volume that varies in response to moving motion device 84 or motor 80.

In another embodiment, the motion device 84 and/or motor 80 are moving with respect to a mechanical barrier such as a mechanical shoulder that prevents the motion of the motion device 84 in at least one direction. In yet another embodiment, the compensation fluid volume may be taken from a confined volume of compressible fluid such as gas, e.g. air. Hence, if the motion device 84 and/or motor 80 are moving with respect to a mechanical barrier that prevents the motion in at least one direction, and the compensation fluid volume is taken from a confined volume of compressible fluid such as gas, e.g. air, the configuration may be operable without a pressure compensator 90.

Components housed in the module 64 may be powered via an energy storage device 94, such as a battery, a capacitor, a supercapacitor, a fuel cell, and/or a rechargeable battery.

In addition to, or in place of, energy storage device 94, the module 64 may include the energy transmitting/receiving device 96 to provide power to control the steering direction and perform other functions. Using energy transmitting/receiving device 96, energy may be transmitted to and/or received from surface assembly 22 via conductors (not shown) extending along the drill string 12 to an energy storage device (also not shown), such as batteries, rechargeable batteries, capacitors, supercapacitors, or fuel cells, arranged within the rotating part of the BHA, or to energy converters that converts one energy form (e.g. vibration, fluid flow such as the flow of the drilling fluid, relative motion/rotation of parts, such as the relative motion between the drive shaft 52 and the non-rotating sleeve 60) into another energy form (e.g. electrical energy, chemical energy within a battery or any combination thereof). Commonly known energy converters used downhole are, for example, turbines converting fluid flow into rotation of mechanical parts, generators/dynamos to convert rotation of mechanical parts into electrical energy, charging devices to convert electric energy into chemical energy of batteries. If the energy is provided downhole for other reasons than to provide energy those energy converters are sometimes referred to as energy harvesting devices.

In one embodiment, the energy transmitting/receiving device 96 includes one or more coils (e.g. energy harvesting coils) that are enclosed within the module 64. The coils are positioned so that they are within a magnetic field generated by a magnetic device (or devices) mounted on the drive shaft 52 or at other suitable locations.

In one embodiment, the magnetic device includes one or more magnets 98 (FIG. 3), such as electromagnets (e.g. coils, such as coils wound around magnetic material) or permanent magnets or a combination of both, that are attached to and rotate with the drive shaft 52 or other rotating component, thereby generating an alternating magnetic field that is received by the coils of the energy transmitting/receiving device 96. Electromagnets may include one or more conductive coils on the rotating drive shaft 52. Current can be applied to the conductive coils to generate a magnetic field. The current that is applied to the conductive coils may be modulated to create a modulated magnetic field, which may be used for communication and/or which may allow energy transfer into the module even when the drive shaft 52 is not rotating (or there is at least no substantial relative rotation between the drive shaft 52 and the sleeve 60). Communication via antenna 68 and/or energy transmitting/receiving device 96 may be controlled by communication controller 92.

The energy transmitting/receiving device 96 described herein uses magnetic energy transmission through a separator into an encapsulated unit (e.g., the energy harvesting coils). The magnetic energy coupling is accomplished, in one embodiment, by generating and varying a primary magnetic field by the magnetic device, which is received by a secondary device. The secondary device can be one or more stationary coils mounted in an appropriate direction and position with respect to the time-varying or alternating magnetic field created by the magnetic device. In this way, mechanical energy is converted directly into electrical energy.

The energy transmitting/receiving device 96 may include an energy controller 100 that may include a data storage device, for controlling power supply to components in the module, and/or to control the charge and re-charge of the energy storage device 94. The energy controller 100 may include a rectifier to generate a DC current from the received electrical energy that will be provided to other electronics within the module 64 by the energy controller 100. The energy controller 100 can be a distinct controller, or can be configured to control multiple components in the module, such as the energy transmitting/receiving device 96, the communication device for wireless communication, such as antenna 68, and/or the biasing element 62. As such, one or more of the energy controller 100, the communication controller 92, and the controller 88 to control the biasing element 62 may be actually the same or distinct controlling devices or control circuits with various control functions as appropriate. That is, the scope of this disclosure is not limited as to where which control function is implemented.

In one embodiment, the secondary device includes another magnetic device disposed in the primary magnetic field. The secondary device can be configured to be rotated or otherwise moved by the primary magnetic field and/or generate a secondary magnetic field.

Figure 10:
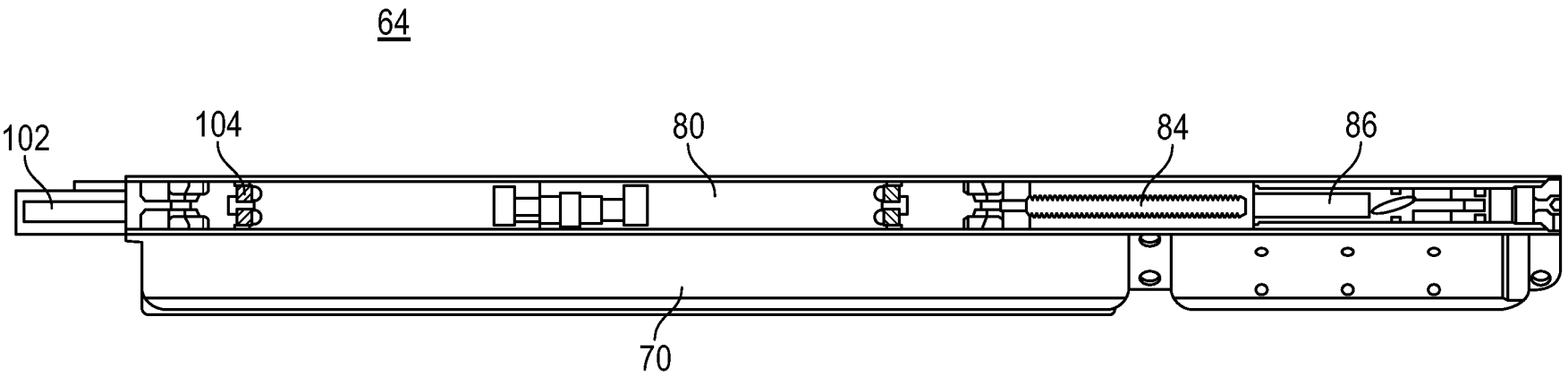
FIG. 10 is cross-sectional view of the module of the steering assembly of FIG. 9.

FIGS. 7-10 show an example of a secondary magnetic device configured to be positioned in the primary magnetic field. In this example, the secondary magnetic device includes a secondary shaft 102 disposed inside or connected to the module 64. The secondary shaft 102 is supported by bearings or another suitable mechanism so that the secondary shaft 102 is able to rotate independent of the sleeve and the module 64 as a response to the primary magnetic field created by the magnets 98 rotating with the drive shaft 52. The secondary shaft 102 can feature magnets, electrical coils or other devices attached to allow a torque transfer from the primary magnetic field to the secondary magnetic field. The secondary magnetic field can be created by, e.g., permanent magnets, eddy current devices, electrical coils and/or hysteresis materials. As shown in FIG. 10, the secondary shaft can be operably connected to an alternator device 104 to convert mechanical energy into electrical energy that can be provided to various components, e.g., to provide power to the motor 80 and/or charge an energy storage device. Optionally, a gear box (not shown), including a gear (also not shown), e.g. a planetary gear may be connected between the secondary shaft 102 and the alternator device 104 to achieve a more efficient energy transfer.

The modules described herein improve and facilitate the application of directional force (e.g., via biasing elements) to control the direction of a drilling assembly. In one embodiment, the modules are configured to house active biasing mechanisms, such as pistons, levers and pads that are actively controlled via a controller. In another embodiment, the biasing mechanisms can be supported by passive mechanisms such as springs, e.g., to engage the earth formation even in the event of a loss of the ability to actively control the biasing mechanisms. Both passive and active elements can be confined. For example, the biasing element 62 can be partially energized by springs. If the energy storage capacity of the energy storage device 94 turns out to be too small to provide communication and active earth formation engagement, the biasing element 62 can be energized by the springs exclusively or as an adjunct to an active biasing element.

In certain embodiments, a conventional communication device is not used to transfer information between a rotating section and a non-rotating section of a drill string. By conventional communication device, it is meant an arrangement wherein information is encoded into electrical, electromagnetic, or optical signals that are transmitted from a transmitter to a receiver, either with wires or wirelessly. Instead of using such encoded signal transmissions, downhole tools according to the present disclosure may be configured to directly or indirectly estimate a rotational speed (RPM) of the rotating section relative to the non-rotating section. At the surface, such relative rotation may be controlled in a manner that instructs one or more components of the non-rotating section to take one or more desired actions. Such instructions may be referred to as downlinks or "command signals."

Figure 11:
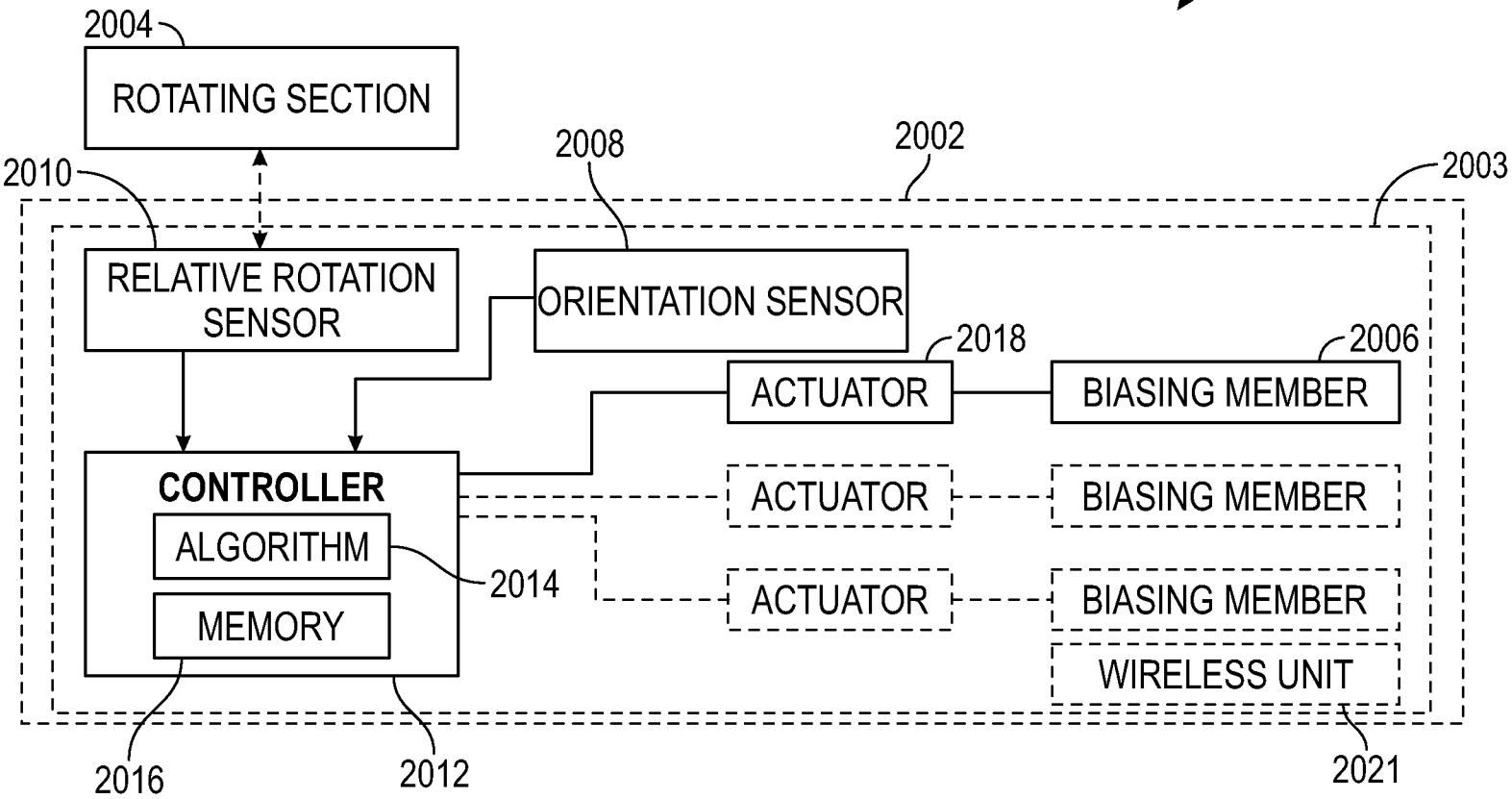
FIG. 11 depicts in functional format an embodiment of a bottomhole assembly that can be controlled using downlinks represented by drill string rotation variations.

Referring to FIG. 11, there is illustrated in functional block diagram format a bottomhole assembly (BHA) 2000 that uses drill string rotation variances in order to send downlinks/command signals. The BHA 2000 may include a non-rotating section 2002 that at least partially surrounds a rotating section 2004 of a drill string 12 (FIG. 1). In embodiments, the non-rotating section 2002 may be similar to the non-rotating sleeve 60 of FIGS. 2, 3 and the rotating section 2004 may be similar to the drive shaft 52 of FIGS. 2, 3. For brevity, the term "non-rotating section" 2002 may be used interchangeably with the term "non-rotating sleeve" 2002. Additionally, the term "rotating section" 2004 may be used interchangeably with the term "drive shaft" or "rotating shaft" 2004.

The non-rotating sleeve 2002 may include one or more biasing elements 2006, one or more orientation sensors 2008, one or more relative rotation sensors 2010, and a controller 2012. All of these components may be enclosed in a module 2003. The biasing elements 2006 may be similar to the biasing elements 26 of FIG. 1 or the biasing elements 62 of FIG. 2. Examples of biasing elements include devices such as cylinders, pistons, wedge elements, hydraulic pillows, expandable rib elements, blades, and others. The biasing elements 2006 may be actuated using any of the mechanisms discussed previously in connection with the biasing elements 26 (FIG. 1) and the biasing elements 62 (FIG. 2). Examples of the control mechanism include, a hydraulic pump and/or a hydraulically controlled actuator, and a motor, such as an electric motor. The controller 2012 may be similar to the controller 88 of FIG. 5 with respect to the components for operating the biasing elements 2006. For example, the controller 2012 may be programmed with suitable algorithms 2014 in memory modules 2016 in order to actuate the actuators 2018 associated with the biasing members 2006. By way of example, the actuators 2018 may include the pumps and valves discussed described above with respect to the controller 88 (FIG. 5). The module 2003 may be similar to the self-contained and modular module 64 as described above (e.g., with respect to FIGS. 2 and 3).

Figure 14:
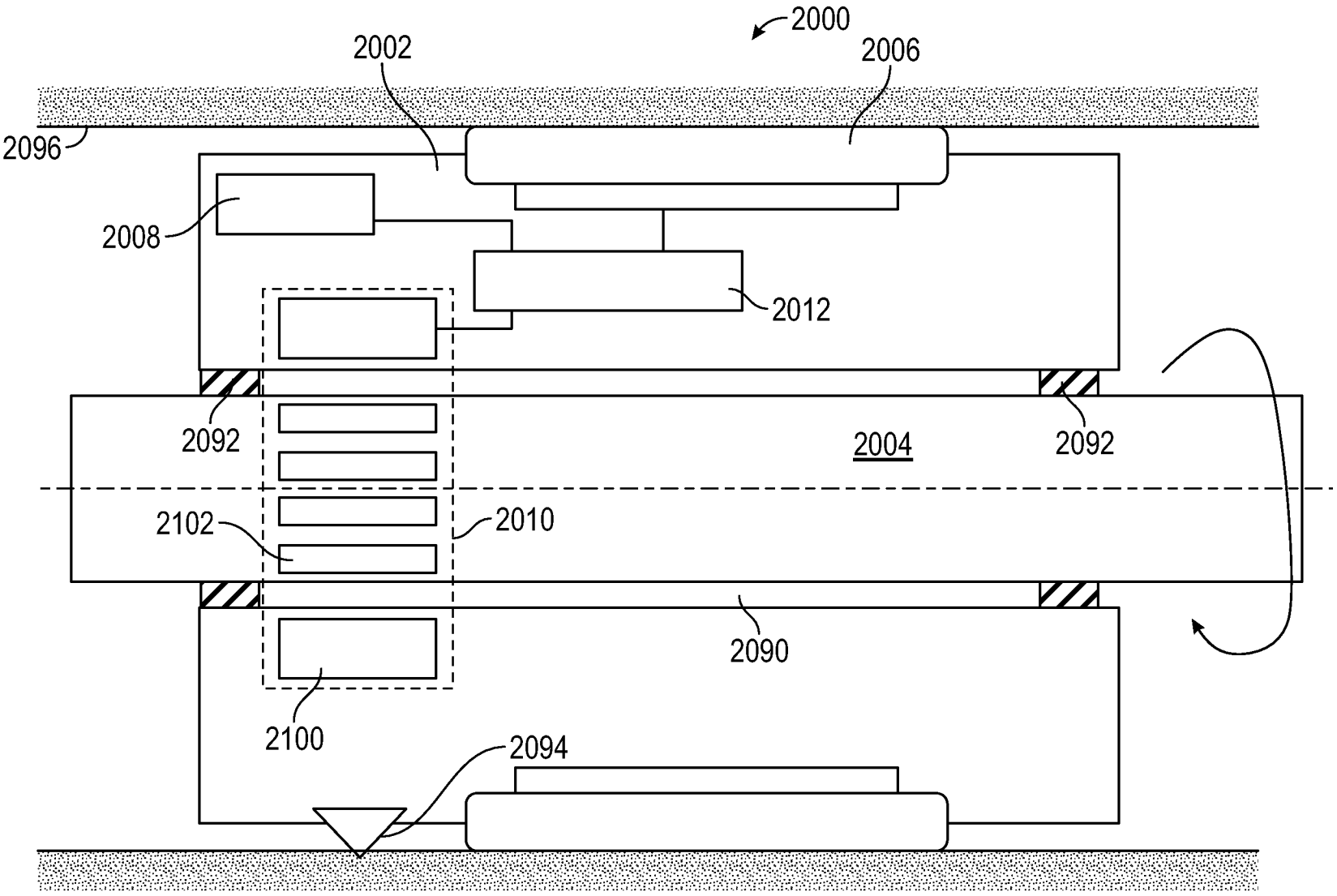
FIG. 14 depicts in schematic format an embodiment of the FIG. 11 bottomhole assembly.

Additionally, the controller 2012 may include suitable algorithms to use information from the orientation sensor 2008 and the relative rotation sensor 2010 in order to control the biasing elements 2006. For example, the controller 2012 may be configured to adjust a force applied by one or more biasing element(s) 2006 and/or adjust a physical position of one or more biasing elements (2006). Generally, the relative rotation sensor 2010 generates information representative of the rotational speed of the rotating section 2004 relative to the non-rotating section 2002, or the "relative rotational speed" of the rotating section 2004. Additionally in some applications the relative rotation sensor 2010 might also detect momentary (angular) position between the rotating section 2004 relative to the non-rotating section 2002. As described above, relative rotation sensor 2010 may also serve as the energy transmitting/receiving device 96 (FIG. 5) and/or the communication device (e.g., in combination with the magnetic device or secondary magnetic device). In such an embodiment the one or more coils (e.g. energy harvesting coils of energy transmitting/receiving device 96) might be enclosed within e.g. the module 64 (FIG. 5) and may be also utilized to sense the magnetic field created by the magnets 98 rotating with the drive shaft 52. The coils are positioned so that they are within a magnetic field generated by a magnetic device (or devices) mounted on the drive shaft 52 or at other suitable locations. In one embodiment, the magnetic device includes one or more magnets 98 (FIG. 3 or 2102 in FIG. 14). The orientation sensor 2008 generates information regarding the orientation of the non-rotating section 2002 relative to selected reference frame such as the earth's magnetic field or the earth's gravitational field. Illustrative orientation sensors 2008 include, but are not limited to, a single axis accelerometer, a multi-axis accelerometer, a single axis or multi axis magnetometer, a gyroscope, etc. Optionally, module 2003 may include a wireless communication unit 2021 to enable signal exchange between the components of modules 2020 and components outside of modules 2020, such as components within the drive shaft 52 (FIGS. 2 and 3). As will be discussed in greater detail below, the controller 2012 uses the information from the relative rotation sensor 2010 to decode a command signal embedded in variances in the rotation of the rotating section 2004 relative to the non-rotating section 2002. The command signal may be an instruction to implement a change in a drilling path. The controller 2012 implements the change in drilling direction after first determining the orientation of the biasing elements 2006 with reference to the selected reference frame and then appropriately positioning or repositioning one or more of the biasing elements 2006.

Figure 12:
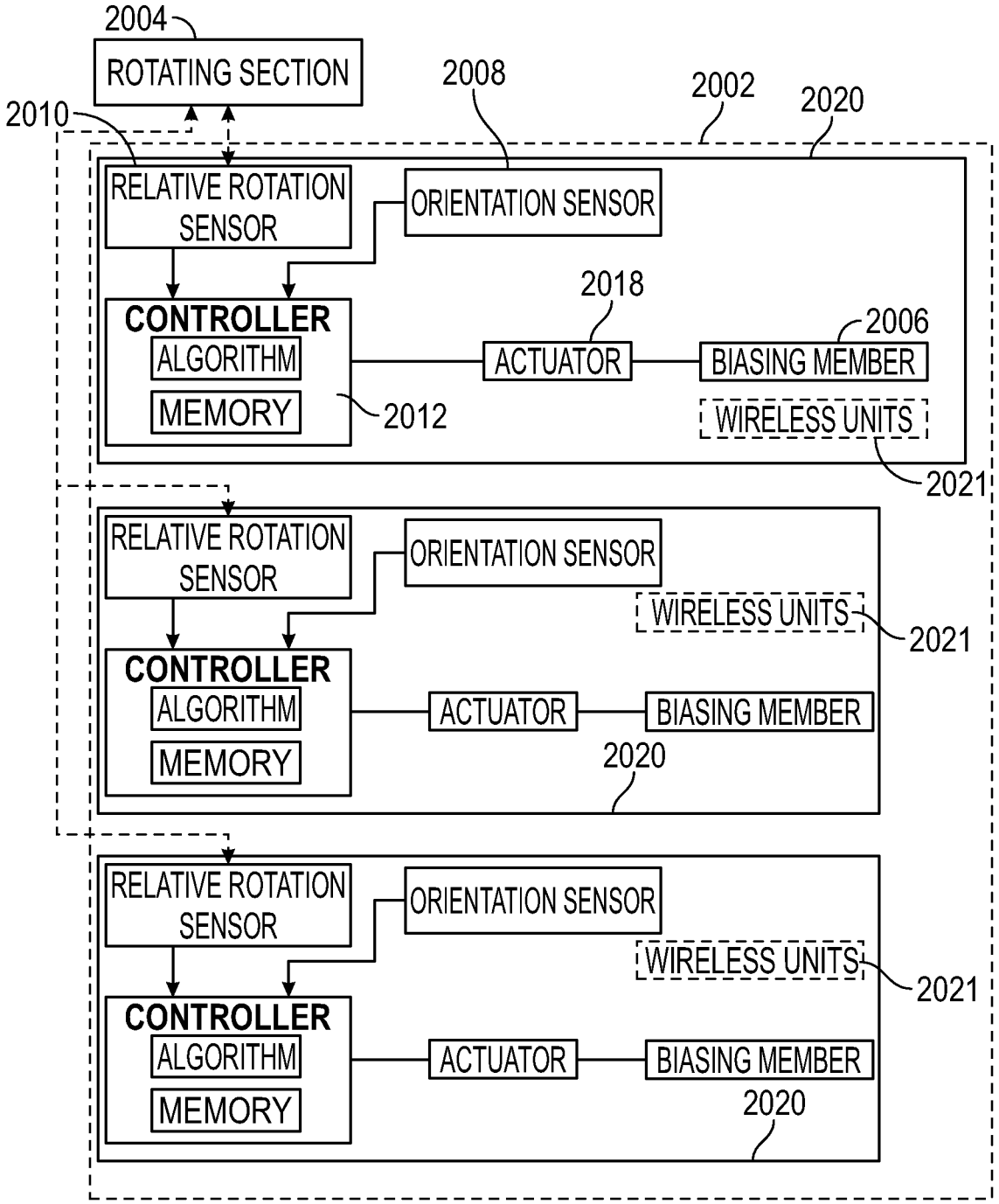
FIG. 12 depicts in functional format an embodiment of a bottomhole assembly that can be controlled using downlinks represented by drill string rotation variations and uses multiple self-contained modules in a non-rotating section.

While FIG. 11 depicts an embodiment wherein a non-rotating sleeve 2002 includes a plurality of biasing elements 2006 controlled by one controller 2012, the teachings of the present disclosure are not limited to such an embodiment. For example, as shown in FIG. 12, the non-rotating sleeve 2002 may include a plurality of self-contained modules 2020, each of which includes a biasing element 2006, associated actuator 2018, controller 2012, orientation sensor 2008, and relative rotation sensor 2010. The modules 2020 may be similar to the self-contained and modular module 64 as described above (e.g. FIGS. 2 and 3). Optionally, one or more of modules 2020 may include a wireless communication unit 2021 to enable signal exchange between the components of the individual modules 2020 and/or components outside of modules 2020, such as components within the drive shaft 52 (FIGS. 2 and 3). It should be understood that the embodiments of the present disclosure are not limited any particular number of biasing elements per module 2020. For example, some modules 2020 may include one biasing element 2006 and other modules 2020 could include two or more biasing elements 2006. Optionally, one or more of modules 2020 may include a wireless communication unit 2021 to enable signal exchange between the components of modules 2020 and components outside of modules 2020, such as components within the drive shaft 52 (FIGS. 2 and 3) or components in one or more of the other modules 2020. In an alternative embodiment, one or more of modules 2020 do not have at least one of the relative rotation sensor and the orientation sensor but receive at least one of the relative rotation information and the orientation information via wireless unit 2021 from one of the other modules 2020, that has a relative rotation sensor and/or an orientation sensor included. Alternatively the orientation information and the relative rotation information may be received in modules 2020 via wireless communication unit 2021 from sensors that are installed in sleeve 2002 outside of any of the modules 2020.

Referring to FIGS. 13 A-D, there are shown illustrative rotational speed variances of the rotating section 2004 that may be used to convey downlinks/command signals from a surface location to the controller(s) 2012 of the non-rotating sleeve 2002. Time is shown along the "X" axis in units such as minutes. Rate of rotation is shown along the "Y" axis in RPM. Generally, the variances involve switching between two specified rotational speeds and specified time durations at each of the specified RPM. While FIGS. 13A-D show the use of two discrete relative rotational speeds, some coding schemes may use three or more discrete relative rotational speeds.

Figure 13A:
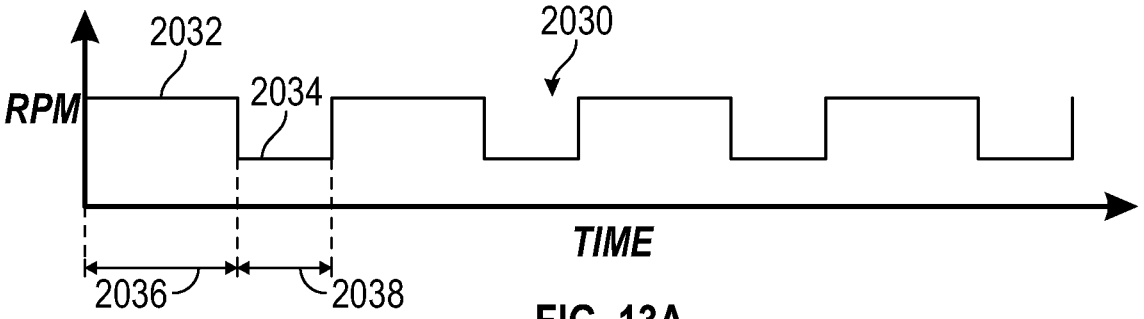
FIGS. 13A-D graphically illustrate unique drill string rotation signatures that can be detected and decoded by the FIG. 11 bottomhole assembly.

FIG. 13A illustrates a downlink represented by a relative rotational speed signature 2030 that begins with a relatively high rate of rotation (RPM) 2032 of the rotating section 2004 (FIG. 11) that drops to a relatively lower rate of rotation (RPM) 2034 after a specified duration of a first time period 2036. After a specified duration of a second time period 2038, the rate of rotation returns to the higher RPM 2032 for the specified duration of the first time period 2036. The time durations of the first and the second time periods 2036, 2038 may be of equal duration or different durations. Such a pattern of higher and lower RPM and associated time durations may uniquely identify a desired change in direction such as "turn left".

Figure 13B:
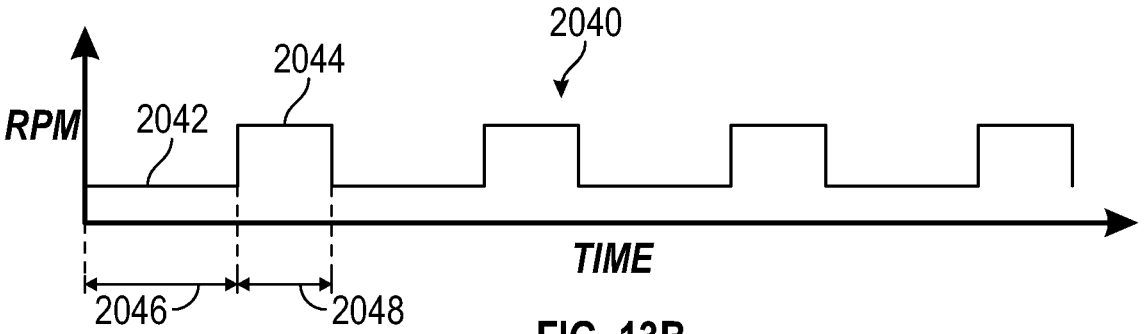

FIG. 13B illustrates a downlink represented by a relative rotational speed signature 2040 that begins with a relatively low rate of rotation (RPM) 2042 of the rotating section 2004 (FIG. 11) that increases to a relatively higher rate of rotation (RPM) 2044 after a specified duration of a first time period 2046. After a specified duration of a second time period 2048, the rate of rotation returns to the lower RPM 2042 for the specified duration of the first time period 2046. The time durations of the first and the second time periods 2036, 2038 may be the same or different. Such a pattern of lower and higher RPM and associated time durations may also may uniquely identify a desired change such as "turn right".

Figure 13C:
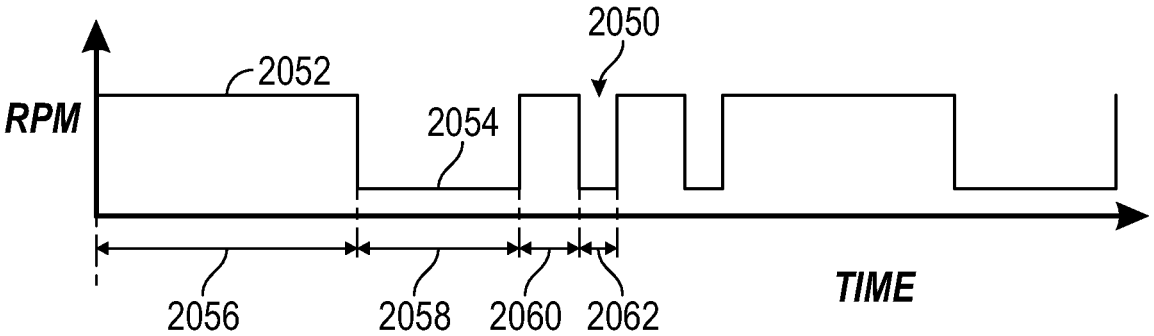

FIG. 13C illustrates a downlink represented by a relative rotational speed signature 2050 that begins with a relatively high rate of rotation (RPM) 2052 of the rotating section 2004 (FIG. 11) that drops to a relatively lower rate of rotation (RPM) 2054 after a specified duration of a first time period 2056. After a specified duration of a second time period 2058, the rate of rotation returns to the higher RPM 2052. Thereafter, the rate of rotation oscillates twice between the higher and lower RPM's 2052, 2054 for relatively shorter third and fourth time periods 2060, 2062. The pattern may then begin again. Such a pattern of higher and lower RPM and associated time durations may uniquely identify a desired change in direction such as "turn up".

Figure 13D:
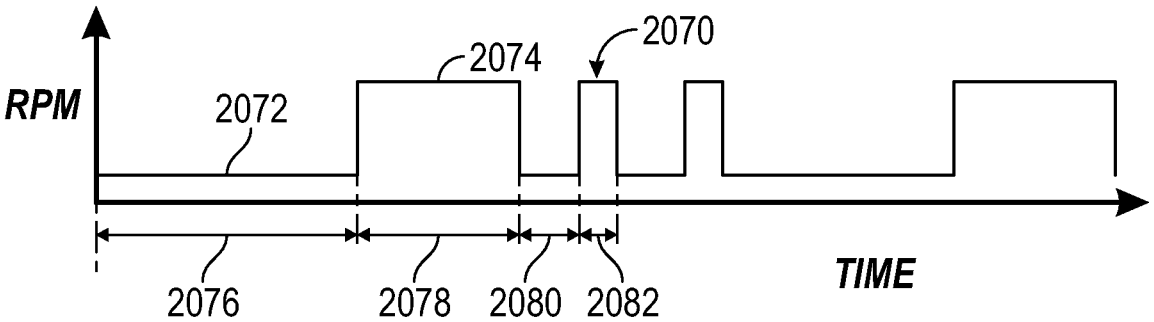

FIG. 13D illustrates a downlink represented by a relative rotational speed signature 2070 that begins with a relatively low rate of rotation (RPM) 2072 of the rotating section 2004 (FIG. 11) that increases to a relatively higher rate of rotation (RPM) 2074 after a specified duration of a first time period 2076. After a specified duration of a second time period 2078, the rate of rotation returns to the lower RPM 2072. Thereafter, the rate of rotation oscillates twice between the lower and higher RPM's 2072, 2074 for relatively shorter third and fourth time periods 2080, 2082. The pattern may then begin again. Such a pattern of higher and lower RPM and associated time durations may uniquely identify a desired change in direction such as "turn down".

Thus, it should be understood that manipulating drill string rotation at the surface can be used to convey downlinks to execute a variety of actions downhole hole. As described above, the downlinks may instruct a change in a drilling direction with respect to inclination and/or azimuth. The downlinks may also adjust a force applied by one or more biasing elements, which may vary a rate at which a drilling direction is changed. The downlinks may also include non-drilling direction commands such as to turn off/on components. While FIGS. 13A-13D are described with respect to simple commands (such as "turn up", "turn down", "turn left", "turn right") by relatively simple RPM pattern, those skilled in the art will understand that patterns like those described with respect to FIGS. 13A-13D are suitable to convey more complicated commands and messages by encoding schemes and protocols as known in the art (such as series of "1" and "0" signals, a pulse position scheme, etc.). More complex commands would enable to support "hold" commands, such as commands to hold a steering parameter (e.g. inclination or azimuth) at a particular value or within a particular range. An example is a command like "hold inclination at 20°". Receiving such a command by RPM patterns via antenna 68 and/or energy transmitting/receiving device 96 (FIG. 5) would cause the controller 88 to control the biasing elements 62 in a way that the steering parameter will be held at a particular value or within a particular range.

It should be appreciated that manipulating drill string rotation by utilizing two or more discrete RPMs and selecting distinct time periods at which the RPM are maintained can allow numerous downlinks/command signals to be communicated to the controller(s) 2012 (FIGS. 11, 12) on the non-rotating section 2002. Of course, there may be practical considerations such as incorporating sufficient magnitude of changes or sufficiently long time durations to enable downhole instruments to detect a change in RPM that is attributed to a communication of command signals as opposed to "noise" associated with drilling operations. However, the teachings of the present disclosure may utilize any scheme, pattern, or regime of changes in rates of rotation and associated time durations, and are not limited to those discussed in connection with FIGS. 13A-D. For example, while the FIGS. 13A-D signals imply the use of a particular relative rotational speed, a coding scheme may use other methodologies. For example, schemes may use a difference between the higher and lower rotational speeds without regard to the actual rotational speeds. Also, schemes may use ranges to form a signature such as an RPM greater than or less than a threshold value; e.g., greater than 150 RPM or less than 100 RPM.

FIG. 14 schematically illustrates one non-limiting configuration of the BHA 2000 according to the present disclosure having the functionalities described in connection with FIGS. 11 and 12. The BHA 2000 may include the non-rotating sleeve 2002 having a bore 2090 in which a rotating section 2004 of the drill string 12 (FIG. 1) is disposed. One or more bearings 2092 may be positioned between the non-rotating sleeve 2002 and the rotating section 2004 to allow relative rotation there between. As described previously, the non-rotating sleeve 2002 may include one or more biasing elements 2006, one or more orientation sensors 2008, one or more relative rotation sensors 2010, and a controller 2012. These components may be housed in a self-contained module as described previously.

Optionally, the BI-IA 2000 may include one or more anti-rotation elements 2094 positioned on the non-rotating sleeve 2002. In some embodiments, the biasing elements 2006 may provide sufficient friction against a borehole wall 2096 to anchor the non-rotating sleeve 2002 substantially stationary relative to the borehole wall 2096. In other embodiments, the anti-rotation element(s) 2094 either cooperatively with the biasing elements 2006 or primarily generate the required friction to anchor the non-rotating sleeve 2002 substantially stationary relative to the borehole wall 2096. The anti-rotation element(s) 2094 may utilize mechanisms similar to the biasing elements 2006 such as springs, pads, etc. In embodiments, the anti-rotation elements 2094 may be static and continuously frictionally engage the borehole wall 2096. In other embodiments, the anti-rotation elements 2094 may be retractable to disengage from the borehole wall 2096 in response to a suitable control signal. It should be understood that the borehole wall 2096 is only illustrative of an adjacent surface against which the biasing elements 2006 and anti-rotation elements 2094 may act. Other adjacent surfaces may be an inner surface of casing, liner, or other wellbore tubular.

In embodiments, the energy transmitting/receiving device 96 (e.g., FIG. 5) may function as the relative rotation sensor 2010 in addition to transmitting and receiving energy for the non-rotating sleeve 2002. In such embodiments, the relative rotation sensor 2010 includes one or more coils 2100 (e.g., energy harvesting coils, alternator coils) and positioned so that they are within a magnetic field generated by a magnetic device 2102 (or devices) mounted on a section of the rotating section 2004.

Figure 15:
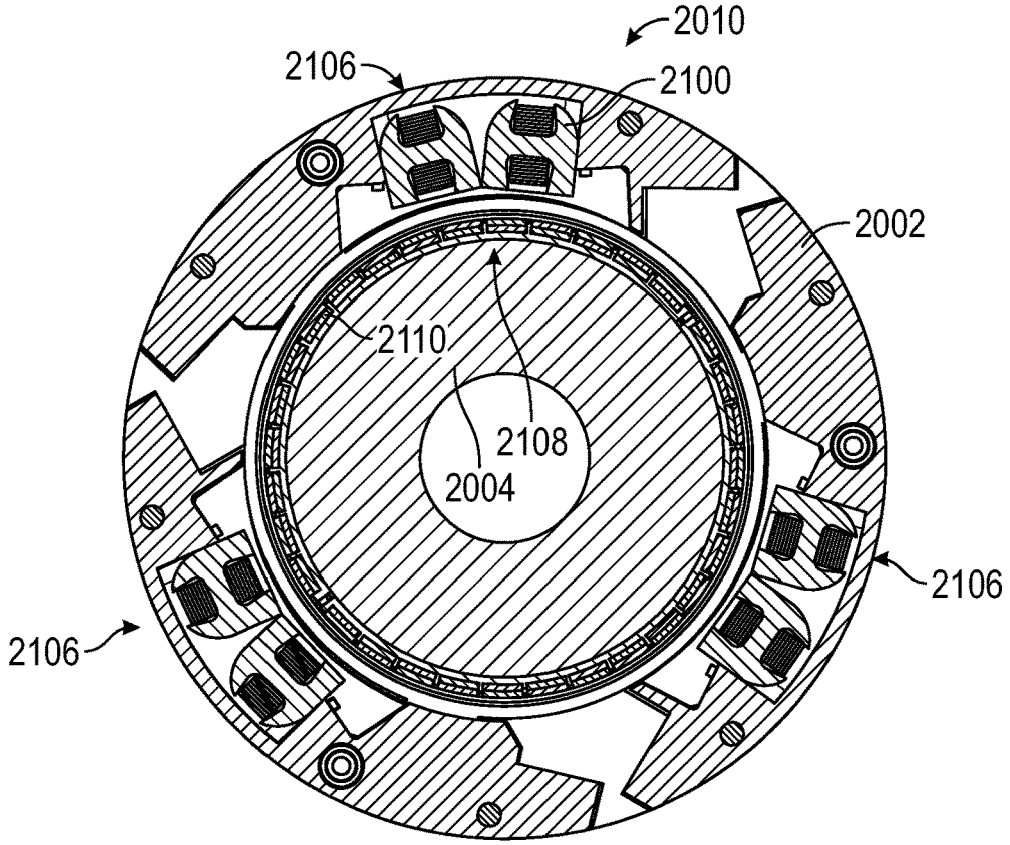
FIG. 15 depicts a sectional end view of a relative rotation sensor in accordance with one embodiment of the present disclosure.

FIG. 15 illustrates a cross-section view of one non-limiting embodiment of an energy transmitting/receiving device that also functions as the relative rotation sensor 2010. The relative rotation sensor 2010 may include one or more coils 2100 disposed in the non-rotating section 2002. In the depicted arrangement, there are three coil sets 2106, each of which has two coils 2100. It should be understood that greater or fewer coil sets 2106 may be used. The relative rotation sensor 2010 also includes a magnetic arrangement 2108 distributed on a section of the rotating section 2004. For example, the magnetic arrangement 2108 may include one or more magnets 2110 or magnetic elements circumferentially arrayed within or on an outer surface of the rotating section 2004. As used herein, terms such as magnets, magnetic elements, or magnetic material refers to any object or member that generates a magnetic field including loops of energized electrical conduits such as coils that are flown by an electrical current. In a conventional manner, during relative rotation between the rotating section 2004 and the non-rotating sleeve 2002 at a constant RPM, the magnetic field generated by the magnetic arrangement 2108 creates an alternating voltage in the coil(s) 2100 that have a constant frequency and a constant peak voltage.

Figure 16A:
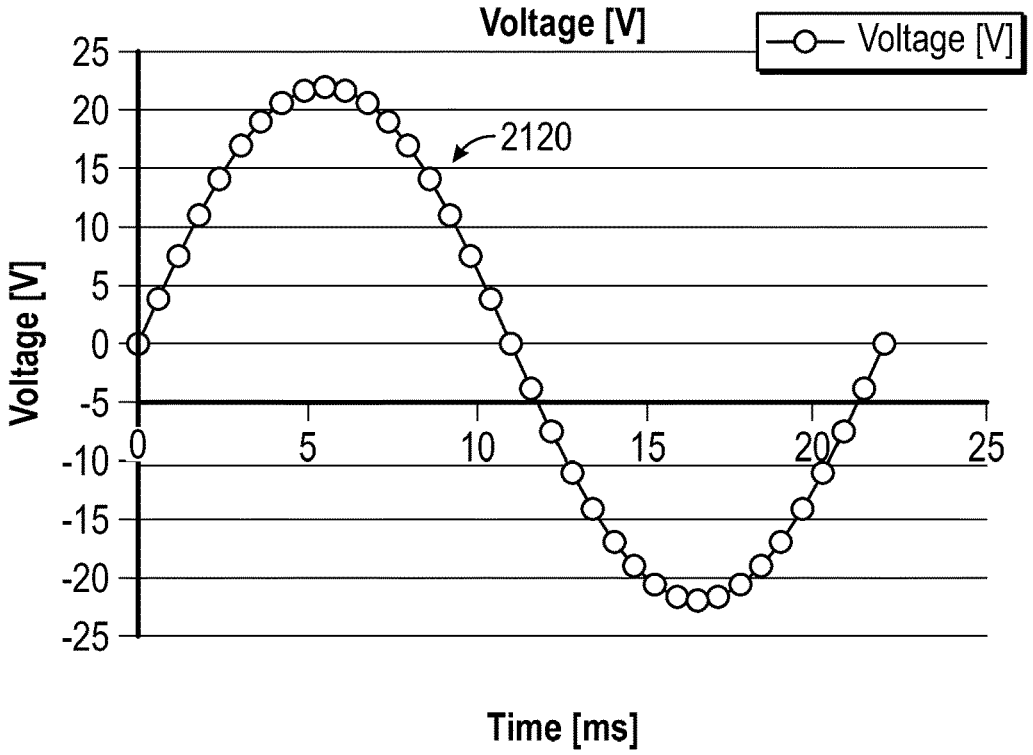
FIGS. 16A-B and 17 graphically illustrate representative voltage signals generated by the FIG. 15 relative rotation sensor.
Figure 16B:
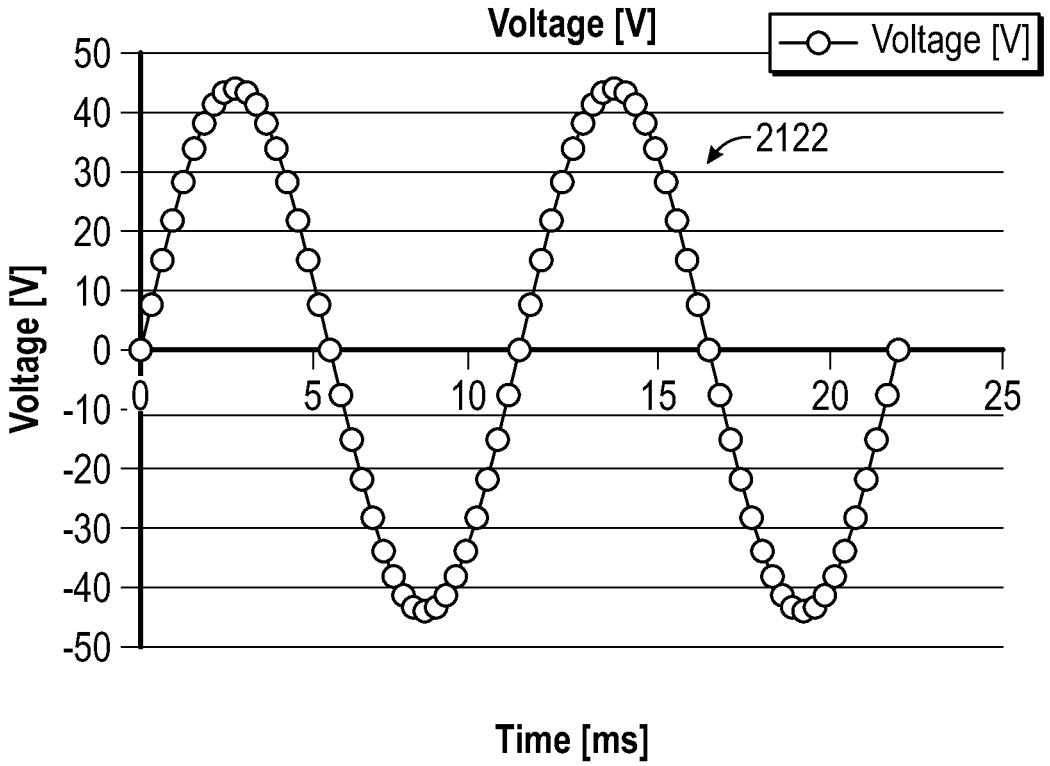

Referring to FIGS. 16A and B, there are shown voltage signals associated with two different constant RPM's that may be generated by the relative rotation of sensor 2010 of FIG. 15. In both graphs, time (ms) is along the "X" axis and voltage (V) is along the "Y" axis. In FIG. 16A, the voltage signal 2120 may have an amplitude of app. 22 Volts and a period of app. 22 milliseconds. The FIG. 16A voltage signal 2120 may occur at a rotational speed of 100 RPM. In FIG. 16B, the voltage signal 2122 may have an amplitude of spp. 44 Volts and a period of 11 milliseconds. The FIG. 16B voltage signal 2122 may occur at a rotational speed of 200 RPM. The FIGS. 16A and B voltage signals and associated rotational speeds are merely exemplary and not intended to represent actual voltage signals at particular rotational speeds. Nevertheless, it should be appreciated that relative rotational speed may be indirectly estimated by analyzing the characteristics of the corresponding voltage signal. The voltage variations shown in FIGS. 16A, B and their associated current flows through coils 2100 of coil sets 2106 may be also used to provide power to components within non-rotating sections 2002, such as to controllers 2012 or biasing members 2006 of FIGS. 11 and 12 or to charge one or more capacitor, supercapacitor, battery, fuel cell, or rechargeable battery within at least one of self-contained modules 2020 of FIGS. 11 and 12.

Figure 17:
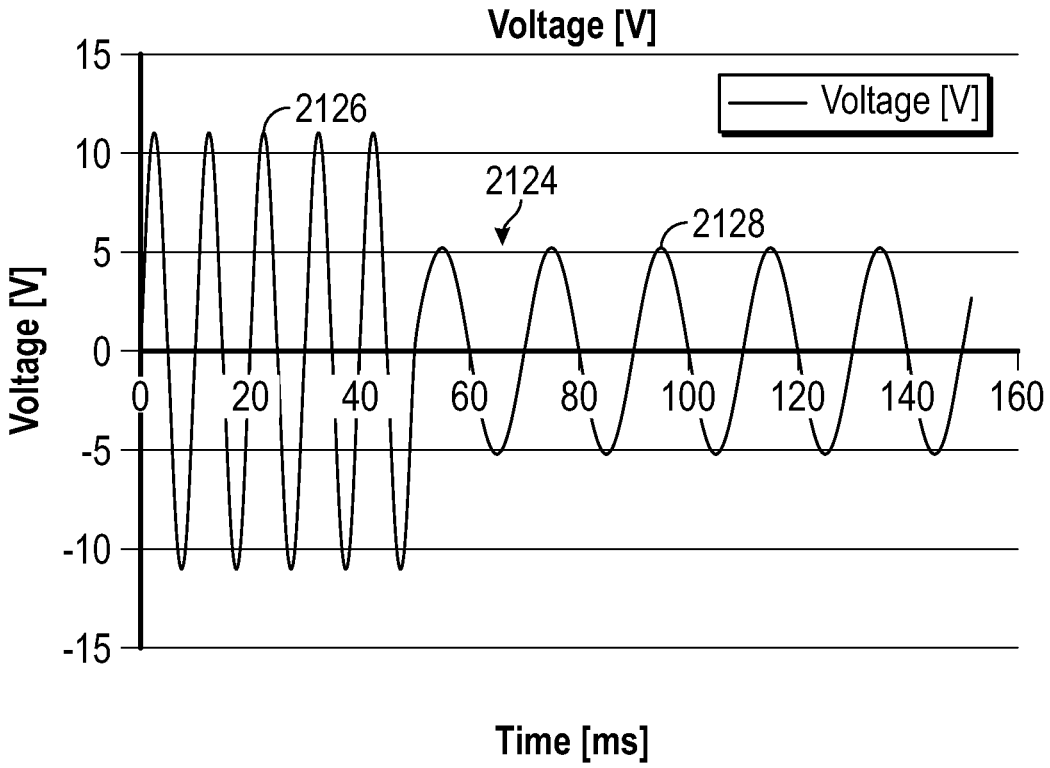

Referring to FIG. 17, there is shown a voltage signal 2124 representative of a transition from a higher RPM to a lower RPM that may be generated by the relative rotation sensor 2010 of FIG. 14 or FIG. 15. Time (ms) is along the "X" axis and voltage (V) is along the "Y" axis. The voltage signal 2124 may have a first segment 2126 associated with a given rotational speed and a second segment 2128 associated with a relatively lower rotational speed. Due to the relatively higher rotational speed, the first segment 2126 has a larger amplitude and a shorter period than the second segment 2128. As described in connection with FIGS. 13A-D, these variances in relative rotational speed, which are detected by measuring voltage signals in the relative rotation sensor 2010, may be used to create unique signatures and convey desired downlinks/command signals from the surface to the controller 2012 (FIG. 14).

It should be noted that the energy transmitting/receiving device described in connection with FIGS. 7-10 may also be used to detect drill string rotation variances as described above. For example, magnets 98 may be used to convey energy from the rotation of drive shaft 52 via secondary shaft 102 into self-contained and sealed module 64. The voltage and current variations in module 64 that correspond to the received energy within module 64 are also sensed to gain information about the rotation (e.g. rotation speed) of the drive shaft relative to the sleeve 60. Identified rotation pattern can then be used to identify commands or messages thereby receiving information from the rotating drive shaft and associated surface assembly 22 at the surface (FIG. 1).

Referring to FIG. 14, in embodiments, the controller 2012 may include algorithms, programs, or other suitable machine-readable instructions that estimate variances indicative of relative rotational speeds using the voltage signals from the relative rotation sensor 2010. These instructions may estimate parameters such as the amplitude, frequency, and/or duration of the signals indicative of relative rotational speeds. The controller 2012 may use one or more of the estimated parameters to determine whether command signals are being conveyed via variations in rotational speed and, if so, decode the command signal to determine the instructions to be executed. It should be understood that it is not necessary that the controller 2012 estimates any given rotational speed. Rather, the controller 2012 may determine a command signal associated with a given pattern or sequence of rotational speed variances using only the associated voltage signals without performing a calculation to determine the RPM for a detected voltage signal.

Figure 18:
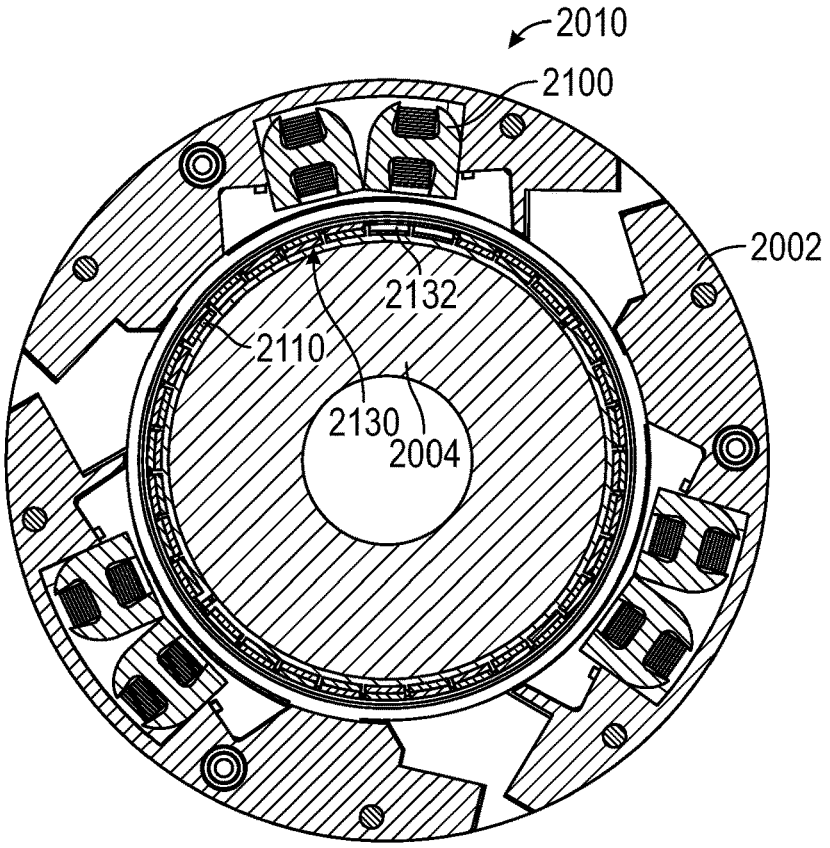
FIG. 18 depicts a sectional end view of a relative rotation sensor in accordance with one embodiment of the present disclosure that generates a non-homogenous magnetic field.

Referring to FIG. 18, there is shown another embodiment of a relative rotation sensor 2010 that also provides a signal to estimate a relative position between the rotating section 2004 and the non-rotating section 2002. The relative rotation sensor 2010 may include one or more coils 2100 disposed in the non-rotating section 2002 as discussed in connection with the FIG. 15 embodiment. To estimate relative position, the relative rotation sensor 2010 includes a magnetic arrangement 2130 that generates a non-homogeneous magnetic field. By "non-homogeneous," it is meant that the magnetic field has a localized engineered variation in a strength of a magnetic field. By "engineered," it is meant that the variation in the magnetic field is an intended feature and has a predetermined signature or characteristic, as opposed to an incidental feature. The magnetic field strength variations, in one arrangement, may be obtained by varying a volume magnetic material at a specified location as compared to the volume of other magnetic material distributed on a section of the rotating section 2004. For example, the magnetic arrangement 2130 may have a sector 2132 that does not have any magnetic material. Thus, the sector 2132 will have a magnetic field that is weaker than the magnetic field in the remainder of the magnetic arrangement 2130.

Figure 19:
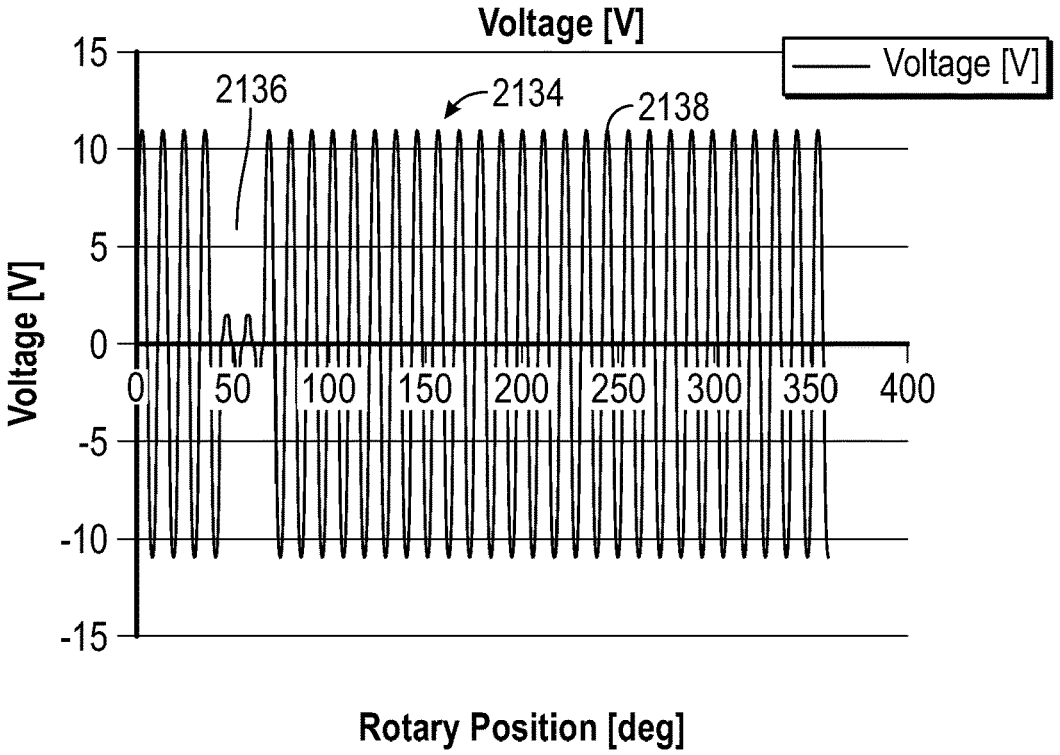
FIG. 19 graphically illustrates a representative voltage signal generated by the FIG. 18 relative rotation sensor.

Referring to FIG. 19, there is shown an illustrative voltage signal 2134 that may be generated by the FIG. 18 embodiment. Time (ms) is along the "X" axis and voltage (V) is along the "Y" axis. The voltage signal of FIG. 19 comprises of voltage oscillations that are caused by the localized variations in the strength of the magnetic field that is generated by the magnetic arrangement 2130 (FIG. 18). The voltage signal 2134 may have a segment 2136 associated with the sector 2132 (FIG. 18) wherein voltage drops due to the weakened magnetic field and a segment 2138 which is the baseline voltage attributable to the remainder of the magnetic arrangement 2130. Thus, the instances when the segment 2134 is detected, the rotating section 2004 has a known orientation or alignment relative to the non-rotating section 2002.

Figure 20:
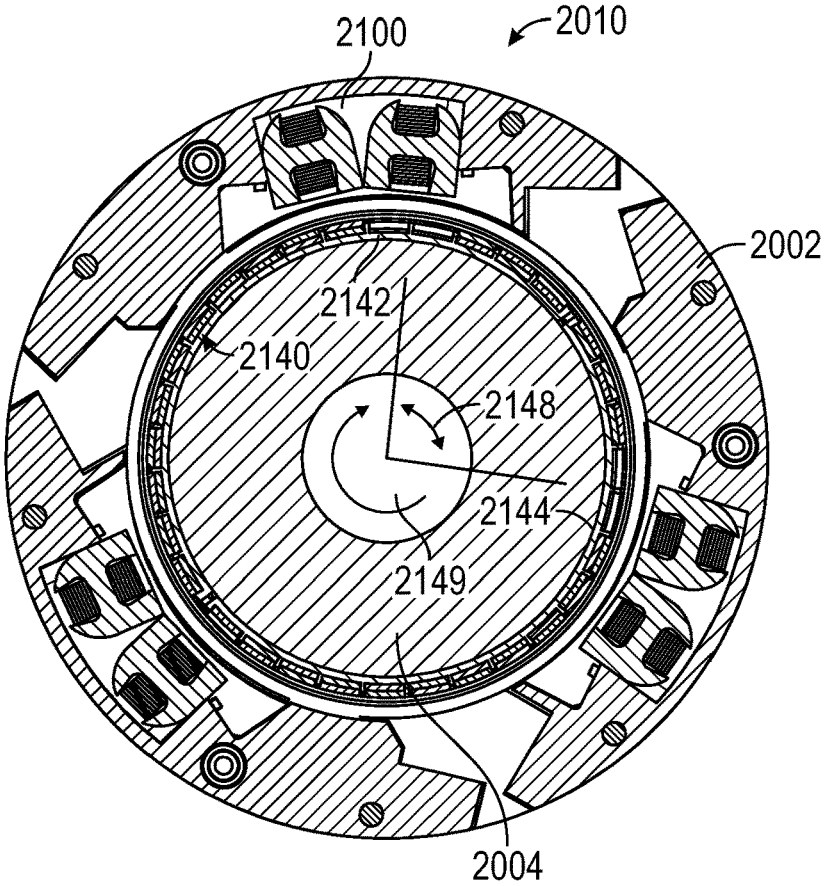
FIG. 20 depicts a sectional end view of a relative rotation sensor in accordance with one embodiment of the present disclosure that generates a non-homogenous magnetic field having a plurality of magnetic field variations.

Referring to FIG. 20, there is shown another embodiment of a relative rotation sensor 2010 that provides a signal to estimate a relative position or rotation between the rotating section 2004 and the non-rotating section 2002 as well as other information. The relative rotation sensor 2010 may include one or more coils 2100 disposed in the non-rotating section 2002 as discussed in connection with the FIG. 15 embodiment. The relative rotation sensor 2010 also includes a magnetic arrangement 2140 positioned on the rotating section 2004 and that generates a non-homogeneous magnetic field. In this arrangement, the magnetic arrangement 2140 may have two or more sectors 2142, 2144 wherein a strength of the magnetic field is lower or higher than that of the adjacent magnetic field. As illustrated, the sectors 2142, 2144 are gaps that have no magnetic material. Thus, the sectors 2142, 2144 will have magnetic fields that are weaker than the magnetic field in the remainder of the magnetic arrangement 2140. In one embodiment, the magnetic arrangement 2140 comprises a set of magnetic multipoles (e.g. magnetic dipoles, quadrupoles, etc.) that are distributed around the circumference of the rotating section 2004, wherein the multipole direction is arranged to create a periodic pattern around the circumference of the rotating section. Sectors 2142, 2144 comprise a magnetic signature that is different from the periodic pattern of magnetic multipoles.

Figure 21:
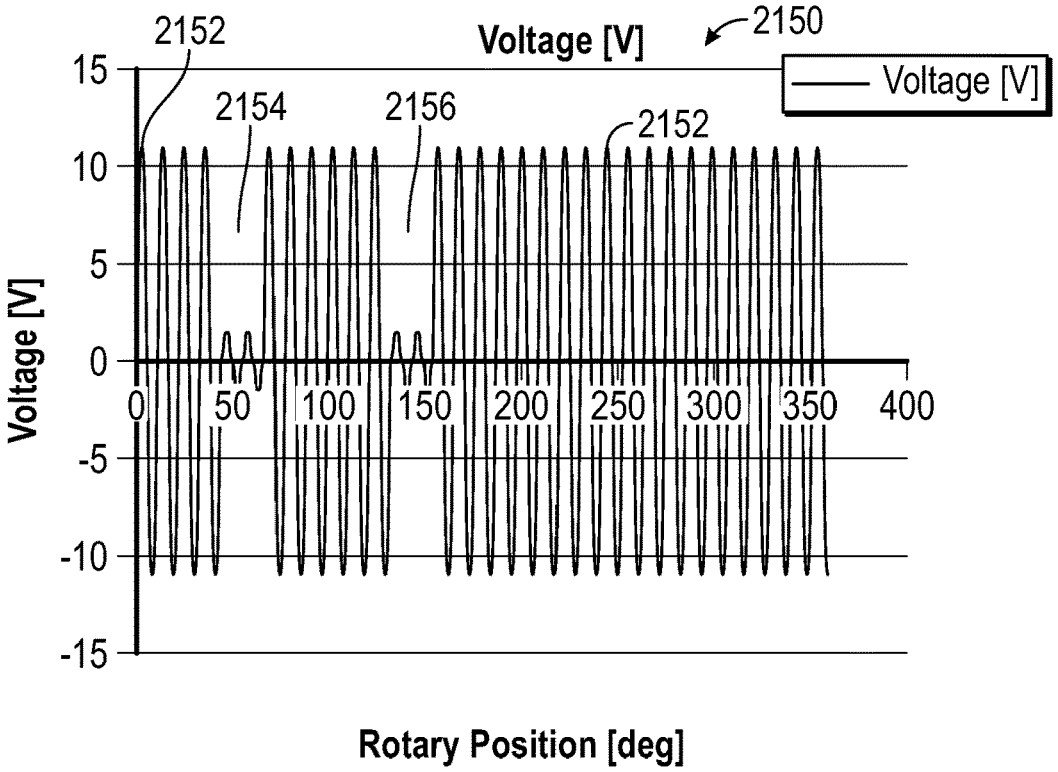
FIG. 21 graphically illustrates a representative voltage signal generated by the FIG. 20 relative rotation sensor.

Referring to FIG. 21, there is shown an illustrative voltage signal 2150 that may be generated by the FIG. 20 embodiment. Time (ms) is along the "X" axis and voltage (V) is along the "Y" axis. The voltage signal 2152 may have a first segment 2154 associated with the sector 2142 (FIG. 20) and a second segment 2156 associated with the sector 2144 (FIG. 20), wherein voltages drop due to the weakened magnetic fields or due to the lower frequency of the magnetic arrangement in sectors 2142, 2144. Thus, the instances when the segments 2142, 2144 are detected, the rotating section 2004 has a known orientation or alignment relative to the non-rotating section 2002. Further, it should be appreciated that the distance or angular separation between the segments 2142, 2144 is known and the time between the detection of the segments 2142, 2144 corresponding to the time between first and second segments 2154 and 2156 can be determined. This information may be used to better evaluate downhole conditions and drilling dynamics. For example, detection of segments 2142, 2144 may be used as a cross-check that validates the voltage signals. That is, if the two segments 2142, 2144 generate similar voltage signals at expected times, then it is more likely that accurate data is being obtained. Further, for a given rotational speed, a theoretical time gap between the detection of the segments 2142, 2144 may be calculated. Discrepancies in the measured time gap may indicate drilling dysfunctions such as stick-slip. As illustrated, the segments 2142, 2144 may be asymmetrically distributed such that there are different time gaps between successive detections. That is, assuming rotation is clockwise, there is a relatively short time gap from detection of segment 2144 to segment 2142 due to a ninety degree angular separation 2148 and a longer time gap from detection of segment 2142 to segment 2144 due to the two hundred seventy degree angular separation 2149. It should be understood that other embodiments may use three or more segments and/or that the segments may be uniformly distributed with equal angular separation or with unequal angular separations. The gaps may have any angular value, not just the ninety degrees and two hundred seventy degrees depicted.

It should be understood that the teachings of the present disclosure are not limited to only reductions in a magnetic field that are obtained by reducing the volume of a magnetic material (e.g., height, width, and/or depth of a magnetic element). For example, an option for a magnetic marker and without weakening the magnetic field would include shaping the magnetic field output.

Figure 22:
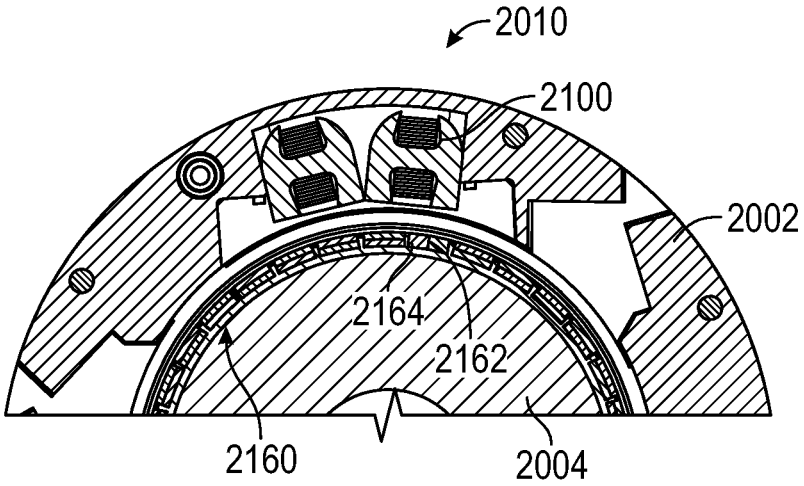
FIG. 22 depicts a sectional end view of another relative rotation sensor in accordance with one embodiment of the present disclosure that generates a non-homogenous magnetic field.

Referring to FIG. 22, there is shown an embodiment of a relative rotation sensor 2010 that provides a signal to estimate a relative position between the rotating section 2004 and the non-rotating section 2002 using a Halbach array. By flipping magnetic elements into a direction 90° from adjacent magnetic elements, a non-homogeneous field is generated, which creates a magnetic field variation in the form of a directed peak of magnetic strength at the Halbach array. The relative rotation sensor 2010 may include one or more coils 2100 disposed in the non-rotating section 2002 as discussed in connection with the FIG. 15 embodiment. The relative rotation sensor 2010 also includes a magnetic arrangement 2160 positioned on the rotating section 2004 and that generates the non-homogeneous magnetic field. In this arrangement, the magnetic arrangement 2140 may have a sector 2162 wherein a magnet 2164 is offset 90° relative to a neighboring magnet. Additionally, sets of magnetic elements having an offset 90° relative to a neighboring magnet may be used. Thus, the sector 2162 will have a magnetic field peak relative to the remainder of the magnetic arrangement 2160. While FIG. 22 uses a technique of 90° offsets for adjacent magnets, other suitable techniques to shape the magnetic field include, but are not limited to, alternative orientation or alternative magnetization of the permanent magnets.

Figure 23:
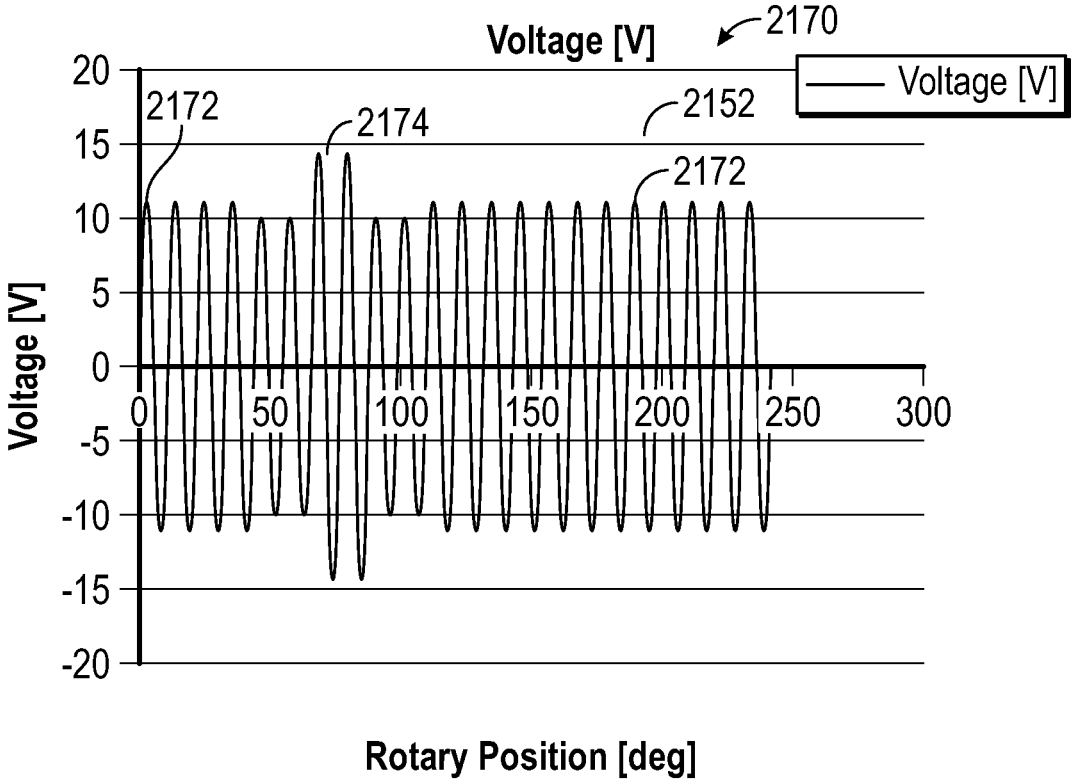
FIGS. 23 and 24 graphically illustrate representative voltage signals generated by the FIG. 22 relative rotation sensor.

Referring to FIG. 23, there is shown a voltage signal 2170 representative of a constant RPM that may be generated by the relative rotation sensor 2010 of FIG. 22. Time (ms) is along the "X" axis and voltage (V) is along the "Y" axis. The voltage signal 2170 may have a nominal voltage amplitude 2172 during a majority of the rotation and a peak voltage amplitude 2174 associated with a sector 2162 (FIG. 22), the voltage spike being caused by the offset magnets 2164 at the sector 2162 (FIG. 22).

Figure 24:
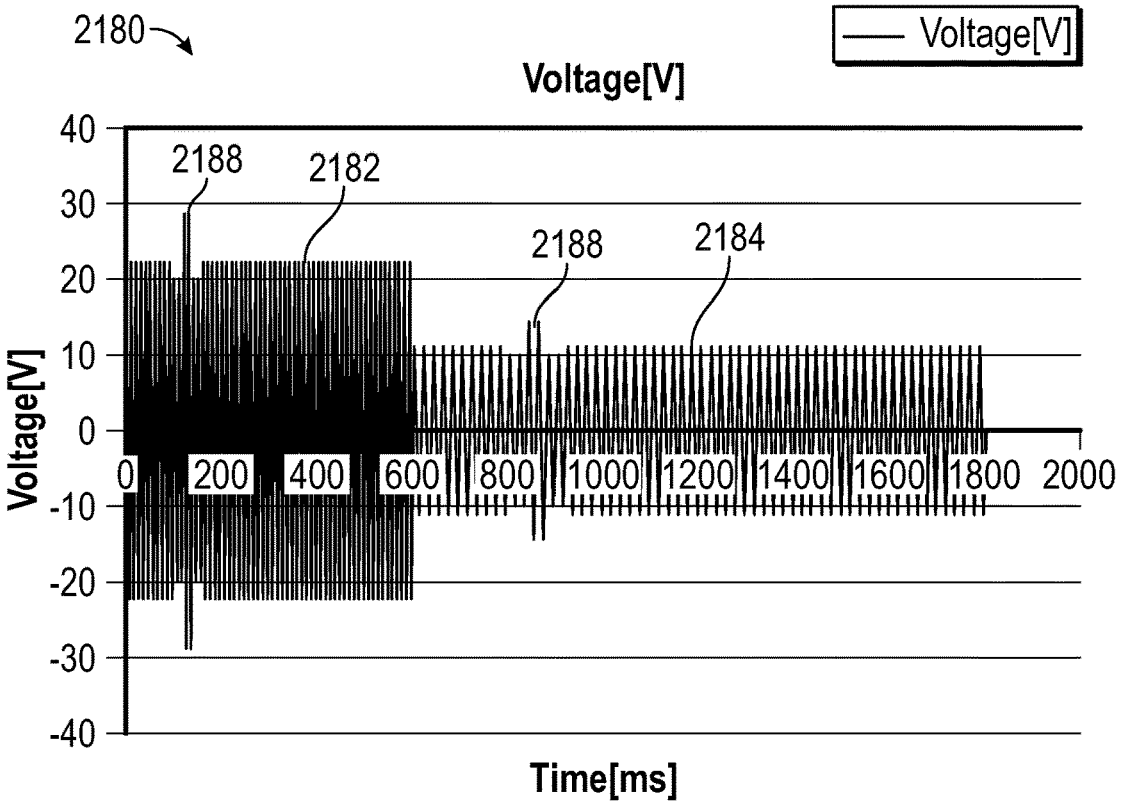

Referring to FIG. 24, there is shown a voltage signal 2180 representative of a transition from a higher RPM to a lower RPM that may be generated by the relative rotation sensor 2010 of FIG. 22. A full rotation is shown at the higher RPM and at the lower RPM. As before, time (ms) is along the "X" axis and voltage (V) is along the "Y" axis. The voltage signal 2180 may have a first segment 2182 associated with a given rotational speed and a second segment 2184 associated with a relatively lower rotational speed. Due to the relatively higher rotational speed, the first segment 2182 has a larger voltage amplitude and a shorter period that the second segment 2184. Further, due to the Halbach array at the sector 2162 (FIG. 22), voltage peaks 2188 are generated, which as described before provide a momentary indication of relative orientation between the rotating section 2004 and the non-rotating section 2002. While the magnetic peak, or signature, would occur at say each 600 ms for the first rotary speed, the marker signature would occur every 1200 ms for the second rotary speed.

Alternatively, a dedicated sensor element can be used to detect the momentary position between rotating stationary components. For example, referring to FIG. 25, a sensor assembly 2200 may include a sensor element 2202 on the non-rotating sleeve 2002 and a triggering element 2204 on the rotating section 2004. One or more biasing elements 2006 may be positioned on the non-rotating sleeve 2002. The sensor element 2202 may use a variety of interactions in order to detect the proximity of the triggering element 2204; e.g., physical contact, electrical interaction, magnetic interactions, etc. In effect, the interaction causes a "tick" to occur once per rotation. For simplicity, this will be referred to as a "singular tick". A non-limiting example may be a hall sensor for the sensor element 2202 and a magnetic element for the triggering element 2204. However, it should be understood that different types of sensing elements and respective triggering elements can also be used.

Figure 25:
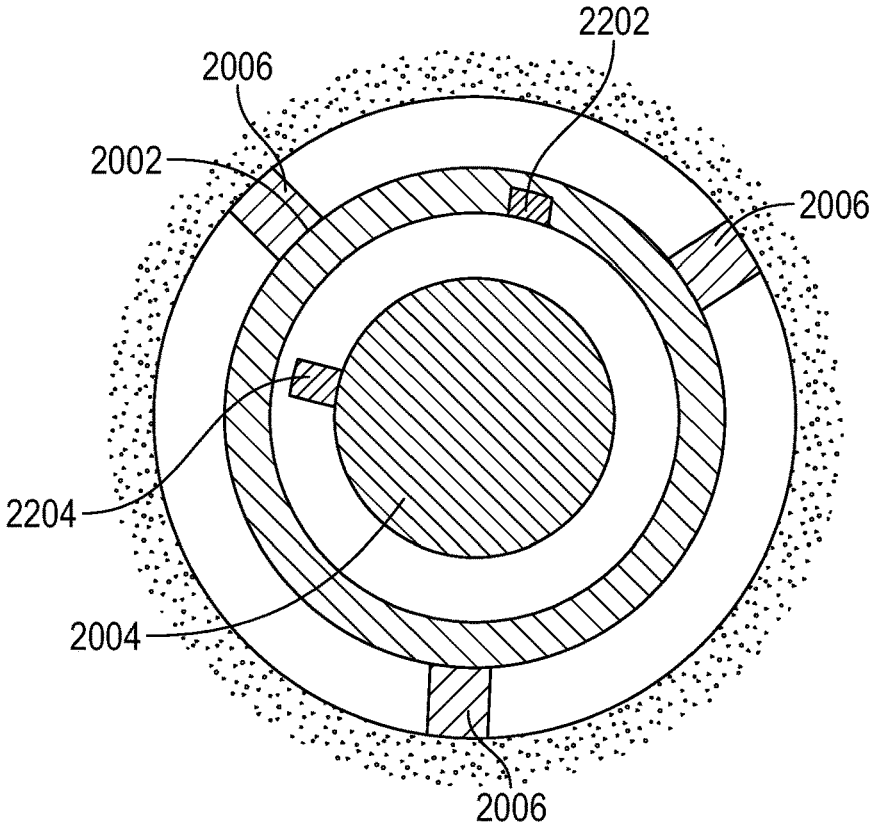
FIG. 25 depicts a sectional end view of a dedicated relative rotation sensor in accordance with one embodiment of the present disclosure that generates a singular tick per drill string rotation.

The previously described relative rotation sensor 2010 according to FIG. 18, 20, 22, 25, as well as the configuration shown in FIG. 25 allow detection of momentary position of the rotating section 2004 relative to the non-rotating section 2002. The momentary relative position can additionally be utilized to count the revolutions over time (rpm measurement). This signal can be used individually for the above described downlink methods (e.g. according to FIGS. 13 A-D) or as verification, in combination, supporting the alternating voltage detection. For applications where sensor communication between the rotating MWD and the non-rotating section is established (e.g. FIG. 1-10), the momentary relative position can be used to synchronize measurements from the rotating section 2004 and the non-rotating section 2002. Such synchronized measurements can be also used for formation evaluation, dynamics, directional and other measurements that beneficially combine the content from the rotating and the non-rotating section. In certain embodiments, a MWD sensor on a rotating section of the string and a processor configured to calculate a steering vector using the identified momentary relative position between the drive shaft and the sleeve and information from the MWD sensor.

Figure 26:
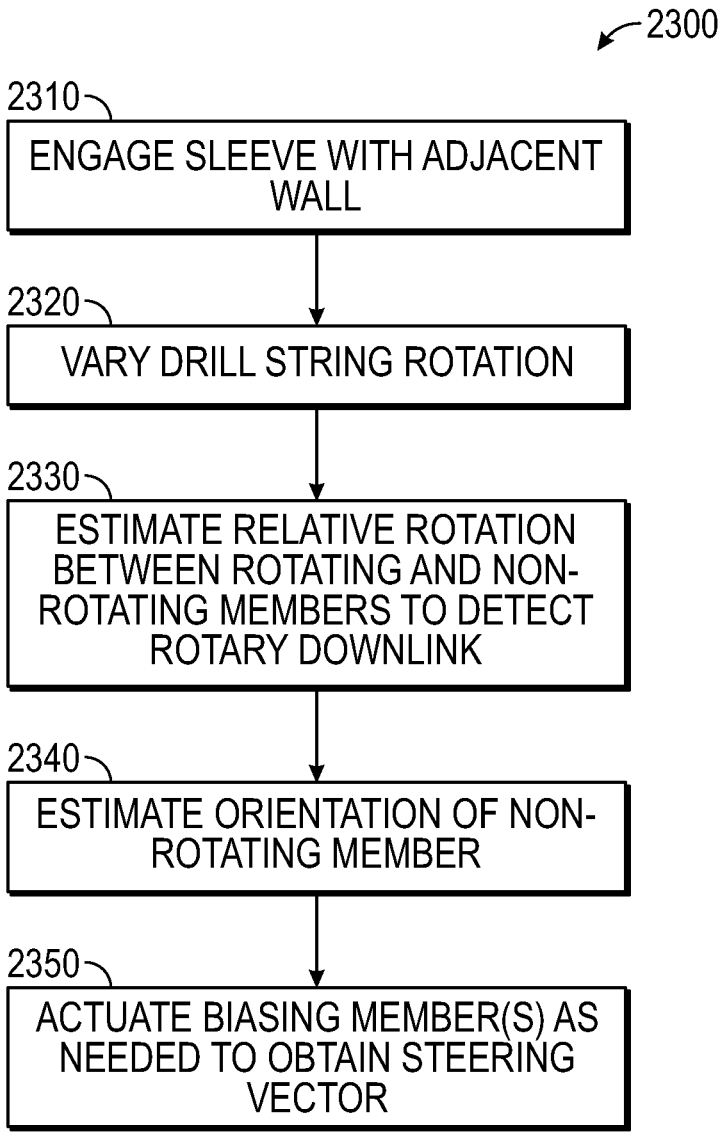
FIG. 26 depicts a flow chart illustrating one method of conveying downlinks to a non-rotation section of a drill string in accordance with one embodiment of the present disclosure.

Referring to FIG. 26, there is shown one non-limiting method 2300 of conveying command signals from a surface location to one or more components on a non-rotating sleeve without using convention communication devices such as transmitters and receivers. The method may be performed in conjunction with the systems and devices described above, but is not limited thereto. The method includes one or more stages, or steps, described below. In one embodiment, the method includes the execution of all of the stages in the order described. However, certain stages may be omitted, stages may be added, or the order of the stages changed.

In preparation for executing the method 2300, a drilling assembly connected to a drill string is deployed into a borehole, e.g., as part of a LWD or MWD operation. Thereafter, the drilling assembly is operated by rotating a drive shaft and a drill bit via a surface or downhole device. In one embodiment, the drive shaft, the rotating section, is surrounded by a non-rotating sleeve, the non-rotating section, that includes one or more modules that house and at least partially enclose one or more biasing elements. In another embodiment, one or more modules are included in the rotating parts of the BHA. One or more components in each module are powered via an energy storage device and/or energy transmitting/receiving device, such as a coil receiving an alternating magnetic field, an inductive coupler, inductive transformer, an inductive power device, movable magnets, mechanical coupling, or magnetic coupling that transforms mechanical energy from drilling fluid flow, rotation of the drive shaft, or vibration of the BHA to electrical energy that power control devices, sensors, and/or actuation devices for the biasing elements.

At a first stage 2310, to cause relative rotation of the drive shaft and the non-rotating sleeve, the initial friction between the non-rotating sleeve and the adjacent surface, which may be a borehole wall or an inner surface of a wellbore tubular, may be generated by the initial actuation or expansion of the one or more biasing elements. For example, friction between biasing elements and the borehole wall might be increased up to a level that is close to or even higher than the friction of the bearing thereby creating an initial resistance of rotation of the non-rotating sleeve with respect to the borehole wall and thus initiate a relative rotation between the drive shaft and the non-rotating sleeve. Alternatively, or additionally, non-rotation elements may be used to physically contact the adjacent surfaces and generate the friction required to allow relative rotation. The relative rotation enables the energy receiving device to convert the energy from drill string rotation to energy for Operating biasing elements, controllers, electronics, sensors, or to charge the energy storage device. The energy storage device may also be re-loaded during operation of the steering assembly by the energy receiving device.

Such biasing elements that are configured to be initially expanded or actuated to increase friction between non-rotating sleeve and borehole wall may be at least one of sliding pads, energized rollers, springs, blades, or rotating levers. Biasing elements that are configured to be initially expanded or actuated to increase friction between non-rotating sleeve and borehole wall may be active elements that require an external energy supply or passive elements that can be actuated or expanded without an external energy supply, such as, for example, springs. If initial expansion or actuation of the biasing elements is provided by active elements, the energy required to expand/actuate the biasing elements by the active elements may be provided by an energy storage device such as a capacitor, a supercapacitor, a battery, fuel cell, or a rechargeable battery. Such energy storage device may also be utilized to energize controllers or sensors within the module.

In a second stage 2320, a decision is made to adjust a direction of drilling. The decision may be human made, by machine, or a combination of both. The decision is converted to a downlink or command signal that has a unique signature/pattern of drill string rotation speeds and associated time durations at different speeds as discussed previously. Surface and downhole equipment is operated to manipulate the drill string rotation to obtain the unique signature/pattern. In case a mud motor is used, the surface rpm will be superimposed by the downhole rpm created by the mud motor. Since the mud motor rpm is a function of drilling fluid flow rate, which is pumped through a surface assembly 22, the superimposed rotational speed of the rotating section 2004 relative to the non-rotating section 2002 is controlled by surface flow and surface rpm. The command signal signature/pattern send from the surface to the downhole tool is variation of surface rpm and/or drilling fluid flow rate for a BHA including a mud motor.

In the third stage 2330, controller(s) on the non-rotating sleeve detect the variations in drill string rotation and use the relative rotation sensor(s) to detect the unique signature of the drill string rotation variations. As discussed previously, the sensors(s) may generate a voltage signal representative of these drill string rotation variations. The controllers(s) may utilize a pre-programmed lookup table or other database to determine the desired action that is associated with the detected unique signature. The desired action may be to change a drilling direction, or other action. The controller(s) on the non-rotating sleeve also use information from the orientation sensor(s) to estimate an orientation or position of the non-rotating sleeve relative to a predetermined reference frame. This information may be used to set the orientation of the non-rotating sleeve with the predetermined reference frame and identify which biasing element(s) should be actuated in order to obtained the desired change in the drilling direction.

In certain embodiments, a MWD sensor on a rotating section of the string and a processor configured to calculate a steering vector using the identified momentary relative position between the drive shaft and the sleeve and information from the MWD sensor. The momentary relative position can also be used to synchronize measurements from the rotating section 2004 and the non-rotating section 2002. Such synchronized measurements can be used for formation evaluation, dynamics, directional and other measurements that beneficially combine the content from the rotating and the non-rotating section.

In a fourth stage 2340, the controller(s) actuate the biasing elements, e.g. to contact the borehole wall. For example, the controllers(s) may operate the actuators to adjust a force applied by one or more biasing element and/or adjust a physical position of one or more of the biasing elements. In such a manner, the biasing element(s) are controlled to control the direction of the drilling assembly.

Set forth below are some embodiments of the foregoing disclosure:

One non-limiting embodiment described above includes an apparatus for use in a wellbore. The apparatus may include a non-rotating section and a non-rotating section disposed along a drill string. The non-rotating section has a bore and at least one biasing element engaging a wall of the wellbore. The rotating section is disposed in the bore of the non-rotating section. The apparatus also includes at least one relative rotation sensor configured to generate signals representative of a rotation of the rotating section relative to the non-rotating section and at least one orientation sensor within the non-rotating section configured to generate signals representative of an orientation of the non-rotating section relative to a selected frame of reference; and a controller. The apparatus further includes a controller in signal communication with the at least one relative rotation sensor and the at least one orientation sensor. The controller is configured to adjust at least one of: (i) a force applied by the at least one biasing element, and (ii) a position of the at least one biasing element, the adjusting being in response to the generated signals representative of a rotation of the rotating section relative to the non-rotating section from the at least one relative rotation sensor and the generated signals representative of an orientation of the non-rotating section relative to a selected frame of reference from the at least one orientation sensor.

One non-limiting embodiment of a method using the above-described apparatus may include disposing a drill string in the wellbore, the drill string including the above-described apparatus. The method may include the further steps of varying a speed of the rotation of the rotating section to transmit a control signal; using the controller to determine the control signal by detecting the rotational frequency variances using the at least one relative rotation sensor; receiving energy within the non-rotating section from the rotation of the rotating section and controlling a force and/or position of the at least one biasing element by using the determined control signal and the generated signals representative of the orientation of the non-rotating section relative to the selected frame of reference from the at least one orientation sensor.

In connection with the teachings herein, various analyses and/or analytical components may be used, including digital and/or analog subsystems. The system may have components such as a processor, storage media, memory, input, output, communications link (wired, wireless, pulsed mud, optical or other), user interfaces, software programs, signal processors and other such components (such as resistors, capacitors, inductors, etc.) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user, or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

What is claimed is:

1. An apparatus for use in a wellbore, comprising:

a drill string configured to drill the wellbore;

a non-rotating section disposed along the drill string, the non-rotating section having a bore and at least one biasing element engaging a wall of the wellbore;

a rotating section disposed in the bore of the non-rotating section;

at least one relative rotation sensor configured to generate signals representative of a rotation of the rotating section relative to the non-rotating section;

at least one orientation sensor within the non-rotating section configured to generate signals representative of an orientation of the non-rotating section relative to a selected frame of reference; and a controller in signal communication with the at least one relative rotation sensor and the at least one orientation sensor, the controller being configured to adjust at least one of: (i) a force applied by the at least one biasing element, and (ii) a position of the at least one biasing element, the adjusting being in response to the generated signals representative of a rotation of the rotating section relative to the non-rotating section from the at least one relative rotation sensor and the generated signals representative of an orientation of the non-rotating section relative to the selected frame of reference from the at least one orientation sensor, wherein the controller is configured to receive information from the rotating section by a signature of rotations of the rotating section, wherein the at least one biasing element is energized using energy received within the non-rotating section from the rotation of the rotating section.

2. The apparatus of claim 1, wherein engagement of the at least one biasing element to the wall causes relative rotation between the non-rotating section and the rotating section when the rotating section is rotated.

3. The apparatus of claim 1, further comprising anti-rotation elements configured to prevent rotation of the non-rotating section relative to the wall of the wellbore.

4. The apparatus of claim 1, wherein the generated signals representative of the rotation of the rotating section relative to the non-rotating section include a characteristic representative of the rotation of the rotating section relative to the non-rotating section, the characteristic being at least one of: (i) a frequency, (ii) an amplitude, (iii) a period, and (iv) a singular tick.

5. The apparatus of claim 1, wherein the generated signals representative of the rotation of the rotating section relative to the non-rotating section are associated with at least one control signal sent from a surface location, and wherein the controller is configured to determine the at least one control signal by processing the signals representative of the rotation of the rotating section relative to the non-rotating section generated by the at least one relative rotation sensor.

6. The apparatus of claim 1, wherein the at least one relative rotation sensor includes at least one magnetic element generating a magnetic field, wherein the at least one relative rotation sensor senses a signal indicative of the relative rotation between the rotating section and the non-rotating section.

7. The apparatus of claim 6, wherein the at least one relative rotation sensor also generates and supplies electrical power using the magnetic field of the at least one magnetic element.

8. The apparatus of claim 6, wherein the at least one magnetic element includes a plurality of magnetic elements arrayed on the rotating section.

9. The apparatus of claim 8, wherein the plurality of magnetic elements are arranged in a periodic pattern around at least a portion of a circumference of the rotating section.

10. The apparatus of claim 9, wherein the plurality of magnetic elements are configured to include at least one discontinuity in the periodic pattern.

11. The apparatus of claim 6, wherein a discontinuity in the magnetic field identifies a momentary relative position between the rotating section and the non-rotating section.

12. The apparatus of claim 11, wherein the at least one discontinuity is distributed around the circumference of the rotating section.

13. The apparatus of claim 6, further comprising a self-contained module comprising the relative rotation sensor, the orientation sensor, the controller, and the biasing element, wherein the self-contained unit is powered by using the magnetic field of the magnetic element.

14. The apparatus of claim 1, further comprising a self-contained module comprising the relative rotation sensor, the orientation sensor, the controller, and the biasing element, wherein the self-contained module is electrically isolated from the non-rotating section.

15. The apparatus of claim 14, wherein the self-contained module includes a wireless communication unit, and wherein the self-contained module communicates via the wireless communication unit.

16. The apparatus of claim 14, wherein the self-contained module contains a power source to power the controller and/or the biasing element.

17. The apparatus of claim 16, wherein the power source is one of: a capacitor, a battery, a supercapacitor, a fuel cell, and a rechargeable battery.

18. A method of using an apparatus in a wellbore, comprising:

disposing a drill string in the wellbore, the drill string being configured to drill the wellbore, wherein the drill string includes:

a non-rotating section disposed along the drill string, the non-rotating section having a bore and at least one biasing element configured to engage a wall of the wellbore, a rotating section disposed in the bore of the non-rotating section, at least one relative rotation sensor configured to generate signals representative of a relative rotation between the rotating section and the non-rotating section, at least one orientation sensor in the non-rotating section and configured to generate signals representative of an orientation of the non-rotating section relative to a selected frame of reference, and a controller in signal communication with the at least one relative rotation sensor and the at least one orientation sensor;

varying a speed of the rotation of the rotating section to transmit a control signal;

using the controller to determine the control signal using the at least one relative rotation sensor;

receiving energy within the non-rotating section from the rotation of the rotating section and controlling a force and/or position of the at least one biasing element by using the determined control signal and the generated signals representative of the orientation of the non-rotating section relative to the selected frame of reference from the at least one orientation sensor.

19. The method of claim 18, further comprising receiving energy within the non-rotating section from the rotation of the rotating section wherein at least one of the determination of the control signal and the control of the force and/or the position is executed by using the received energy.

20. The method of claim 18, wherein the at least one relative rotation sensor includes at least one magnetic element generating a magnetic field.

* * * * *